US011528935B2

(12) United States Patent
Liu et al.

(10) Patent No.: US 11,528,935 B2
(45) Date of Patent: Dec. 20, 2022

(54) OBLIQUELY ARRANGED ULTRASONIC ATOMIZATION SHEET OF AN ATOMIZER IN AN ELECTRONIC CIGARETTE HOUSING

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Hong Yu, Hunan (CN); Yuangang Dai, Hunan (CN); Xinqiang Yin, Hunan (CN); Jianhua Yi, Hunan (CN); Youlin He, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 446 days.

(21) Appl. No.: 16/500,575

(22) PCT Filed: Apr. 13, 2018

(86) PCT No.: PCT/CN2018/082933

§ 371 (c)(1),
(2) Date: Oct. 3, 2019

(87) PCT Pub. No.: WO2018/188642

PCT Pub. Date: Oct. 18, 2018

(65) Prior Publication Data

US 2021/0112858 A1 Apr. 22, 2021

(30) Foreign Application Priority Data

Apr. 13, 2017 (CN) ..... 201710240114.7
Apr. 13, 2017 (CN) ..... 201720385509.1
Apr. 13, 2017 (CN) ..... 201720388747.8

(51) Int. Cl.
*A24F 40/40* (2020.01)
*A24F 40/42* (2020.01)
(Continued)

(52) U.S. Cl.
CPC ..... *A24F 40/40* (2020.01); *A24F 40/05* (2020.01); *A24F 40/44* (2020.01); *A24F 40/485* (2020.01);
(Continued)

(58) Field of Classification Search
CPC ..... A24F 40/40; A24F 40/44; A24F 40/10; A24F 40/46; A24F 40/42
See application file for complete search history.

(56) References Cited

U.S. PATENT DOCUMENTS

2020/0060336 A1* 2/2020 Liu ..... A24F 40/40

FOREIGN PATENT DOCUMENTS

CN 104223369 A 12/2014
CN 204540840 U * 8/2015
(Continued)

OTHER PUBLICATIONS

International Search Report issued in International Application No. PCT/CN2018/082933 dated Jul. 11, 2018, 6 pages.

*Primary Examiner* — Hae Moon Hyeon
(74) *Attorney, Agent, or Firm* — Mautiel Kaposytian Woods LLP; Tzvi Hirshaut

(57) ABSTRACT

An ultrasonic atomization type electronic cigarette includes an ultrasonic atomizer having an ultrasonic atomization sheet, an electronic cigarette housing, an upper cover assembly, and a locking structure. The angle α between the ultrasonic atomization sheet and the central axis of the electronic cigarette is 5° to 85°, preferably 15° to 55°. The housing is provided with an air inlet groove. A first support in the housing includes a receiving cavity for receiving the
(Continued)

ultrasonic atomizer. The upper cover assembly may be used for opening the receiving cavity, and the locking structure may be used for locking the upper cover assembly. A liquid guide structure in the atomizer may include a liquid guide body in which a side of a first liquid guide layer is sandwiched between a side of a second liquid guide layer and an ultrasonic atomization surface.

20 Claims, 17 Drawing Sheets

(51) Int. Cl.

| | |
|---|---|
| ***A24F 40/46*** | (2020.01) |
| ***A24F 40/05*** | (2020.01) |
| ***A24F 40/44*** | (2020.01) |
| ***A24F 40/485*** | (2020.01) |
| ***A24F 40/50*** | (2020.01) |
| ***B05B 17/06*** | (2006.01) |
| *A24F 40/10* | (2020.01) |
| *A24F 40/60* | (2020.01) |

(52) U.S. Cl.
CPC ..... *A24F 40/50* (2020.01); *B05B 17/0661* (2013.01); *B05B 17/0684* (2013.01); *A24F 40/10* (2020.01); *A24F 40/60* (2020.01)

(56) References Cited

FOREIGN PATENT DOCUMENTS

| | | | | | |
|---|---|---|---|---|---|
| CN | 204540840 | U | | 8/2015 | |
| CN | 204670389 | U | | 9/2015 | |
| CN | 205214210 | U | | 5/2016 | |
| CN | 206197036 | U | * | 5/2017 | |
| CN | 206443207 | U | | 8/2017 | |
| CN | 206687168 | U | | 12/2017 | |
| CN | 206687174 | U | | 12/2017 | |
| CN | 207011681 | U | | 2/2018 | |
| CN | 108078009 | A | * | 5/2018 | ..... B05B 17/0615 |
| WO | 2016161554 | A1 | | 10/2016 | |

* cited by examiner

OBLIQUELY ARRANGED ULTRASONIC ATOMIZATION SHEET OF AN ATOMIZER IN AN ELECTRONIC CIGARETTE HOUSING

CROSS-REFERENCE TO RELATED APPLICATIONS

This application is a national phase application of international application number PCT/CN2018/082933 filed on Apr. 13, 2018, which claims priority to Chinese application number 201710240114.7 filed on Apr. 13, 2017, Chinese application number 201720388747.8 filed on Apr. 13, 2017, and Chinese application number 201720385509.1 filed on Apr. 13, 2017. The entire contents of these applications are hereby incorporated herein by reference.

FIELD OF THE INVENTION

The present invention belongs to the technical field of electronic cigarettes, and particularly relates to an ultrasonic atomization type electronic cigarette.

BACKGROUND OF THE INVENTION

The existing ultrasonic atomization type electronic cigarette includes an ultrasonic atomizer and a battery assembly provides power supply for it, and has the following disadvantages:

First, the ultrasonic atomization sheet in the ultrasonic atomizer is perpendicular or parallel to the length direction of the electronic cigarette, so that the ultrasonic atomization sheet in the atomizer easily immerses in the cigarette liquid during use or storage, resulting in slow smoke emission, little smoke, even the phenomenon of sucking cigarette liquid occurred, user experience is poor.

Second, the ultrasonic atomizer and the battery assembly are directly used in combination, the atomizer is entirely exposed, and the user holds the outer wall of the atomizer in hand during smoking. High temperature is generated by the cavitation effect when the ultrasonic atomization sheet operates, which causes the atomizer to be hot to burn the user's hand. At the same time, when the atomizer leaks cigarette liquid, the hand is prone to touching the liquid. In addition, the atomizer is entirely exposed, therefore it is easily damaged, and the use cost is high.

Third, a key switch on a key switch board for controlling the operation of the electronic cigarette is usually small, and the user can only press the key switch with one finger to start the electronic cigarette. If the small key switch is pressed frequently, the finger is prone to pain, the difficulty in pressing is increased, the operation reliability is low, and the user experience is poor.

Fourth, a liquid guide body for the ultrasonic atomizer in the existing ultrasonic atomization type electronic cigarette only includes a single liquid guide layer, and the single-layer liquid guide body attached to an atomization surface of the ultrasonic atomization sheet is easily shattered by long-time high-frequency oscillation of the ultrasonic atomization sheet, those shatters are easily sucked by users, therefore bring damage to user's body, and the mouthfeel of smoke is poor. In addition, due to the shattered liquid guide body, the cigarette liquid is not smoothly guided, and the cigarette liquid guide speed is slowed down, so that the atomization effect of the ultrasonic atomization sheet is affected, smoke volume is small and the mouthfeel of smoke is poor.

SUMMARY OF THE INVENTION

In the existing ultrasonic atomization type electronic cigarette, an ultrasonic atomization sheet is perpendicular or parallel to the length direction of the electronic cigarette and is prone to immersion in cigarette liquid, so that a user easily sucks the cigarette liquid; the atomizer is entirely exposed, therefore it is easily damaged, and the user's hand is easily scalded and easily touches the cigarette liquid. The key switch is small and inconvenient to press, so the user experience is poor. A liquid guide body for the ultrasonic atomizer includes only a single liquid guide layer and it is easily be shattered, So shatters of the liquid guide body are easily sucked by users, The cigarette liquid is not smoothly guided, and the cigarette liquid guide speed is slowed down. The present invention is directed to provide an ultrasonic atomization type electronic cigarette against the above deficiencies of the prior art. The ultrasonic atomization sheet in the atomizer is obliquely arranged in the electronic cigarette housing, and thus is unlikely to immerse in cigarette liquid when being used or stored; the atomizer is arranged inside and the outer side wall of the atomizer is not in direct contact with the electronic cigarette housing, and the temperature of the electronic cigarette housing is low, so scalding the user's hand or touching the cigarette liquid is unlikely to occur, the atomizer is unlikely to be damaged, the use cost is low, and the electronic cigarette is clean and sanitary; the key switch is convenient to operate, so the user experience is good; the user hardly sucks shatters of liquid guide body, and the cigarette liquid is guided smoothly.

In order to solve the above technical problems, the technical solution adopted by the present invention is as follows:

An ultrasonic atomization type electronic cigarette includes an ultrasonic atomizer, the ultrasonic atomizer including an ultrasonic atomization sheet, wherein the angle between the ultrasonic atomization sheet and the central axis of the electronic cigarette is $\alpha$, and the value of $\alpha$ is 5° to 85°, preferably 15° to 55°.

With the above structure, the ultrasonic atomization sheet is not immersed in cigarette liquid either when the electronic cigarette is used or stored, so smoke is emitted fast, the smoke volume is large, and the user hardly sucks the cigarette liquid.

Further, the ultrasonic atomization type electronic cigarette includes an electronic cigarette housing and a nozzle connected to the electronic cigarette housing, wherein the electronic cigarette housing is provided with an air inlet groove, a first support is arranged in the electronic cigarette housing, a receiving cavity for receiving the ultrasonic atomizer is formed in the first support, and the angle between the central axis of the receiving cavity and the central axis of the electronic cigarette is $\alpha$; and the air inlet groove, an atomization surface of the ultrasonic atomization sheet, and the nozzle are connected in sequence.

With the above structure, after the ultrasonic atomizer is assembled inside the electronic cigarette housing, since the receiving cavity of the first support has an inclination angle $\alpha$, the ultrasonic atomizer also has an inclination angle $\alpha$ inside the electronic cigarette housing, and the ultrasonic atomization sheet also has an inclination angle $\alpha$ inside the electronic cigarette housing. Since the ultrasonic atomizer is assembled inside the electronic cigarette housing, the user does not directly hold the atomizer housing when in use, scalding the hand or touching the cigarette liquid is unlikely to occur, and the ultrasonic atomizer is unlikely to be damaged.

Further, a cavity is formed between the outer side wall of the first support and the inner side wall of the electronic cigarette housing, and the air inlet groove, the cavity, an air groove on the inner side wall of the receiving cavity, the atomization surface of the ultrasonic atomization sheet, and the nozzle are connected in sequence.

With the above structure, air enters the cavity inside the electronic cigarette housing from the air inlet groove, then enters the ultrasonic atomizer through the air groove on the receiving cavity, takes away the smoke generated by the ultrasonic atomization sheet, and enters the user's mouth through the nozzle. Since the ultrasonic atomizer is not in direct contact with the electronic cigarette housing, the hand can be further prevented from being scalded, and the air can also take away part of heat.

Further, the ultrasonic atomizer is detachably connected to the first support, and further includes an upper cover assembly capable of opening the receiving cavity, and a locking structure capable of locking the upper cover assembly.

The ultrasonic atomizer is used as a separate component, and can be conveniently replaced after use, thus ensuring ease of use and stability of the flavor of the cigarette liquid.

As a preferred manner, the upper cover assembly includes a flip cover and a gasket that can press the ultrasonic atomizer, the gasket and the nozzle are respectively located at two ends of the flip cover, one side of the flip cover is pivotally connected to the first support, and the other side of the flip cover is provided with a locking groove; the locking structure includes a rotating buckle, the rotating buckle is pivotally connected to the first support, and the rotating buckle is provided with a locking buckle that matches the locking groove.

With the above structure, the closure of the flip cover is fixed by the rotating buckle arranged on the first support. After the ultrasonic atomizer is assembled into the receiving cavity, the gasket fixed on the flip cover presses the ultrasonic atomizer, thereby good contact of the electrodes will not affected by shaking, ensuring normal transmission of airflow and avoiding blow-by and air leakage at the same time. The lower side of the rotating buckle is pressed to disengage the locking buckle from the locking groove of the flip cover, and the flip cover is opened, so that the ultrasonic atomizer can be taken out.

Further, the electronic cigarette housing includes an upper side housing and a lower side housing which are oppositely arranged, and a side housing and a decorative block which are oppositely arranged; the upper side housing is connected to the lower side housing through the side housing, the bottom of the lower side housing is provided with a bottom cover for sealing, the top of the upper side housing is provided with a top cover for sealing, one end of the decorative block is pivotally connected to the first support, and the other end of the decorative block is clamped in the upper side housing; a key switch board is arranged in the electronic cigarette housing, a key switch is arranged on the key switch board, and a pressing column in contact with the key switch is arranged on the decorative block.

With the above structure, the whole decorative block is held and pressed, and the pressing column on the decorative block drives the key switch to press down, thus completing the switching operation. Compared with the conventional single-finger pressing, the holding and pressing contact area is larger, the holding and pressing are convenient, the operation is reliable, and the user experience is good.

Further, the ultrasonic atomization type electronic cigarette includes a compression spring, wherein the pressing column is in contact with the key switch after passing through the first support, one end of the compression spring abuts against the inner side wall of the decorative block, and the other end of the compression spring abuts against the outer side wall of the first support.

With the above structure, when the user holds and presses the switch, the compression spring always has an outward thrust, which can increase user's strength of holding and pressing the switch, increase the hand feel, and improve the product quality. Further, one side of the flip cover is pivotally connected to the first support through a first rotating shaft, and a first torsion spring is sleeved on the first rotating shaft.

When the flip cover of the upper cover assembly is disengaged from a buckling position of the locking buckle of the rotating buckle, the torque of the first torsion spring automatically opens the upper cover assembly to facilitate the insertion and removal of the ultrasonic atomizer.

Further, the rotating buckle is pivotally connected to the first support through a second rotating shaft, and a second torsion spring is sleeved on the second rotating shaft. After the rotating buckle locks the flip cover, the torque of the second torsion spring can press the flip cover to ensure the locking reliability.

As a preferred manner, one end of the decorative block is pivotally connected to the first support through a third rotating shaft.

The decorative block is fixed on the first support by the third rotating shaft, so that the decorative block can be properly held and pressed, and supported by enough force without shaking. The top of the decorative block has a longer holding and pressing stroke, and the bottom has a shorter holding and pressing stroke, that is, the holding and pressing stroke is gradually increased from the bottom to the top.

Further, the electronic cigarette housing further includes a transparent block opposite to a central through region of the decorative block, the inner side wall of the transparent block fits the outer side wall of the decorative block, and the transparent block is buckled with the first support.

The whole transparent block is held and pressed, and the pressing column on the decorative block drives the key switch to press down, thus completing the switching operation. Since the coverage of the transparent block is large, the user can hold and press conveniently.

The top end of the decorative block is provided with a buckling position, and the buckling position is directly inserted into the first support and a groove on the upper side housing. When the user presses the transparent block and then releases it, the decorative block is reset outward under the elastic force of the compression spring, and in this case, the decorative block and the transparent block are blocked by the upper side housing to prevent them from falling out of the upper side housing.

As a preferred manner, the air inlet groove is formed at a peripheral edge of the decorative block.

Air enters the cavity inside the electronic cigarette from the air inlet groove on the periphery of the decorative block, then enters the ultrasonic atomizer through the air groove on the receiving cavity, takes away the smoke generated by the ultrasonic atomization sheet, and enters the user's mouth through the nozzle.

Further, the ultrasonic atomizer includes an atomization sleeve, the ultrasonic atomization sheet is arranged in the atomization sleeve, a cigarette liquid cavity and a liquid guide structure for connecting the cigarette liquid cavity with the ultrasonic atomization sheet are further arranged in the atomization sleeve, and the liquid guide structure includes a liquid guide body; the liquid guide body includes a first liquid guide layer and a second liquid guide layer, and a side of the first liquid guide layer is sandwiched between a side of the second liquid guide layer and the atomization surface of the ultrasonic atomization sheet.

With the above structure, the second liquid guide layer is used for adsorb the shatters generated by the shattered first liquid guide layer, which can prevent the user from sucking the shatters generated by the shattered liquid guide body, reduce the harm to the body and increase the mouth feel of smoke.

As a preferred manner, the first liquid guide layer and the second liquid guide layer are both cup-shaped, the first liquid guide layer is wrapped outside the second liquid guide layer, and the bottom surface of the first liquid guide layer is sandwiched between the bottom surface of the second liquid guide layer and the ultrasonic atomization sheet.

As another preferred manner, the first liquid guide layer is cup-shaped, the second liquid guide layer is flaky, and the second liquid guide layer covers the inner bottom surface of the first liquid guide layer.

With the above structure, the second liquid guide layer not only can absorb the shatters generated by the shattered first liquid guide layer, but also can timely supplement cigarette liquid to the first liquid guide layer for atomization, so that the cigarette liquid is guided more smoothly, the atomization effect of the ultrasonic atomization sheet is good, the smoke volume is large, and the smoke tastes good. When the second liquid guide layer is flaky, the second liquid guide layer is directly attached to the inner bottom surface of the first liquid guide body, thereby reducing the operation difficulty of product assembly and reducing the production cost.

As a preferred manner, the first liquid guide layer is made of a wear-resistant material. Preferably, the wear-resistant material is ceramic.

As a preferred manner, the second liquid guide layer is a filter screen.

The first liquid guide layer and the second liquid guide layer are different in liquid guide effect, the first liquid guide layer is mainly considered not to be shattered by the ultrasonic atomization sheet, and the second liquid guide layer is mainly used for guiding cigarette liquid. Therefore, the first liquid guide layer is made of an ultra-high wear-resistant material having certain liquid guide effect (e.g., microporous ceramics, etc.), and the second liquid guide layer is made of a material having good liquid guide effect (e.g., liquid guide cotton, a high-density filter screen, etc.).

Further, the bottom surface of the first liquid guide layer is provided with a through hole for connecting the bottom surface of the second liquid guide layer with the atomization surface of the ultrasonic atomization sheet.

One side of the first liquid guide layer near the atomization surface is provided with a through hole, so that the smoke generated by high frequency oscillation can quickly pass through the liquid guide body, and the smoke generation velocity is improved. At the same time, the cigarette liquid adsorbed by the second liquid guide layer can also be quickly guided to the surface of the ultrasonic atomization sheet through the through hole.

Further, the liquid guide structure further includes a liquid reservoir wrapped on the outer side wall of the first liquid guide layer, and the outer side wall of the liquid reservoir is communicated with the cigarette liquid cavity.

Further, the ultrasonic atomizer further includes a threaded sleeve support, a negative contact plate, an atomization seat, a negative threaded sleeve, a positive conductive terminal and a terminal block, wherein the ultrasonic atomization sheet is placed in the atomization sleeve and is perpendicular to the axis of the atomization sleeve, the atomization seat is arranged in the top of the negative threaded sleeve, the top of the outer side wall of the negative threaded sleeve is screwed to the bottom of the inner side wall of the threaded sleeve support, the bottom end of the atomization sleeve is sleeved outside the threaded sleeve support, the terminal block is arranged in the bottom of the negative threaded sleeve, and the positive conductive terminal passes through the terminal block and abuts against a positive conductive layer of the ultrasonic atomization sheet; one end of the negative contact plate fits a negative conductive layer of the ultrasonic atomization sheet, and the other end of the negative contact plate passes through the atomization seat and is in contact with the negative threaded sleeve; an elastic electrode abutting against the positive conductive terminal is arranged on the bottom surface of the receiving cavity, and the elastic electrode is fixedly connected to the key switch board through a first contact plate; a second contact plate abutting against the negative threaded sleeve is arranged on the side wall of the receiving cavity.

The elastic electrode and the second contact plate are arranged at the bottom of the receiving cavity of the first support, and have a pushing/clamping effect on the removal/insertion of the ultrasonic atomizer, thereby facilitating the insertion and removal of the ultrasonic atomizer.

With the above structure, the electrical conductivity is reliable: the elastic electrode is fixed in the first support, and is clamped by the first contact plate arranged on the key switch board to conduct anode current; the second contact plate is fixed on the first support, and when the ultrasonic atomizer is assembled into the receiving cavity of the first support, the metal housing (negative threaded sleeve) of the ultrasonic atomizer is connected to the second contact plate to conduct cathode current.

Further, the ultrasonic atomizer further includes an air outlet tube, an air tube support, a nozzle, an atomization support, a threaded sleeve support, a negative contact plate, an atomization seat, a negative threaded sleeve, a positive conductive terminal and a terminal block, wherein the ultrasonic atomization sheet is perpendicular to the axis of the atomization sleeve, the top end of the air outlet tube is communicated with the nozzle, the bottom end of the air outlet tube extends into the inner cavity of the liquid guide body, the top end of the side wall of the air tube support is provided with an air inlet, the air outlet tube is sleeved in the air tube support, and an air inlet channel for connecting the air inlet with the air outlet tube is formed between the inner side wall of the air tube support and the outer side of the air outlet tube; the bottom of the outer side wall of the air tube support is screwed to the top of the inner side wall of the atomization support, the side wall of the liquid guide body is sleeved outside the side wall of the atomization support, the external of the liquid reservoir is sleeved with a threaded sleeve support, the threaded sleeve support is provided with a liquid passing hole for connecting the cigarette liquid cavity with the liquid reservoir, the atomization seat is arranged in the top of the negative threaded sleeve, the top of the outer side wall of the negative threaded sleeve is screwed to the bottom of the inner side wall of the threaded sleeve support, the terminal block is arranged in the bottom of the negative threaded sleeve, and the positive conductive terminal passes through the terminal block and abuts against the positive conductive layer of the ultrasonic atomization sheet; one end of the negative contact plate fits the negative conductive layer of the ultrasonic atomization sheet, and the other end of the negative contact plate passes through the atomization seat and is in contact with the negative threaded sleeve.

The ultrasonic electronic cigarette atomizer with the above structure has reliable electrical conductivity, the air channel is unlikely to block, and the liquid channel is unobstructed.

As a preferred manner, the cigarette liquid cavity is formed by the outer side wall of the air tube support, the inner side wall of the atomization sleeve, and the outer side wall of the threaded sleeve support.

Further, the ultrasonic atomizer further includes an atomization cover, the top end of the air outlet tube is fixedly connected to the atomization cover and communicates with the nozzle, and the air inlet groove, the cavity, the air groove on the inner side wall of the receiving cavity, the air inlet, the air inlet channel, the atomization surface of the ultrasonic atomization sheet, the air outlet tube, and the nozzle are connected in sequence.

With the above structure, air enters the air inlet channel from the air groove in the receiving cavity through the air inlet, then enters the ultrasonic atomization sheet, takes the smoke atomized by the ultrasonic atomization sheet away through the air outlet tube, and reaches the user's mouth through the nozzle.

Further, a Printed Circuit Board (PCB) is further arranged in the electronic cigarette housing, and a light guide strip corresponding to the PCB is arranged on the upper side housing.

Further, a spring is arranged in the receiving cavity. When the ultrasonic atomizer is placed in the receiving cavity, the bottom end of the spring abuts against the bottom surface of the receiving cavity, and the top end of the spring abuts against the inner bottom surface of the ultrasonic atomizer.

The spring is arranged in the receiving cavity, and the spring can ejects the ultrasonic atomizer from the receiving cavity after the upper cover assembly is opened, so that the user can replace the ultrasonic atomizer conveniently.

Compared with the prior art, the ultrasonic atomized sheet disclosed in the present invention is not immersed in cigarette liquid either when it is used or stored, so that smoke is emitted fast, the smoke volume is large, the smoke tastes good, and the user hardly sucks the cigarette liquid; when the ultrasonic atomized sheet in use, scalding the user's hand or touching the cigarette liquid is unlikely to occur, the atomizer is unlikely to be damaged, the use cost is low, the atomizer is convenient to insert and remove, the key switch is convenient to operate, the operation is reliable, and the user experience is good; the user can be prevented from sucking the shattered liquid guide body, the harm to the body is reduced, the cigarette liquid is guided smoothly, the atomization effect is good, the smoke volume is large, the smoke is generated quickly, and the smoke tastes good.

Figure 1:
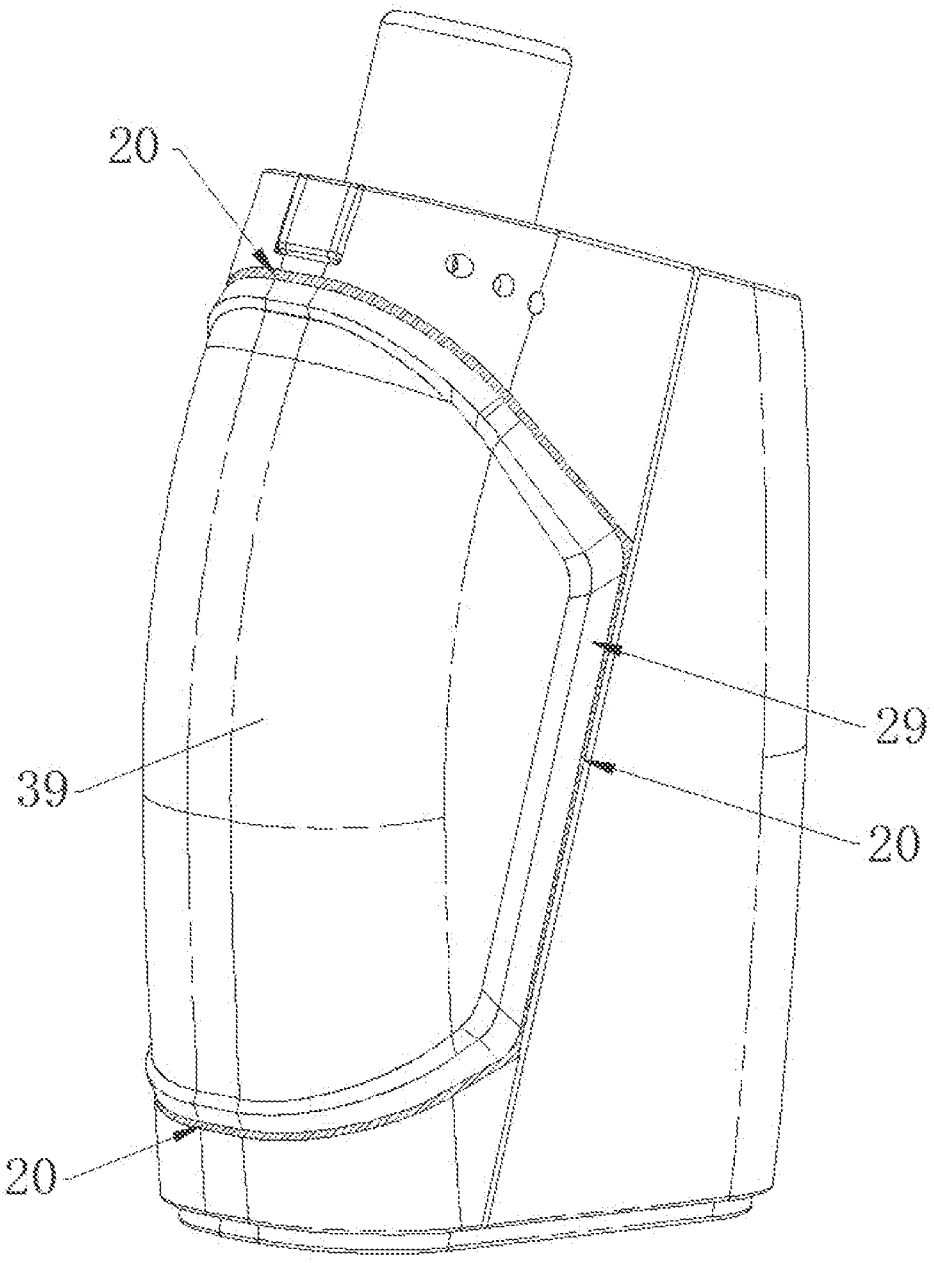
FIG. 1 is an external schematic view of Embodiment 1 of an electronic cigarette.

In which, I ultrasonic atomizer, II electronic cigarette housing, III upper cover assembly, IV locking structure, 1 ultrasonic atomization sheet, 2 liquid reservoir, 3 nozzle, 4 liquid guide body, 401 first liquid guide layer, 411 through hole, 402 second liquid guide layer, 5 atomization sleeve, 6 cigarette liquid cavity, 7 air outlet tube, 8 air tube support, 81 air inlet, 9 atomization support, 10 threaded sleeve support, 101 liquid passing hole, 11 negative contact plate, 12 atomization seat, 13 negative threaded sleeve, 14 positive conductive terminal, 15 terminal block, 16 air inlet channel, 17 sealing ring, 18 cotton pressing spring, 19 atomization cover, 20 air inlet groove, 21 first support, 211 receiving cavity, 212 air groove, 22 cavity, 23 flip cover, 231 locking groove, 24 gasket, 25 rotating buckle, 251 locking buckle, 26 upper side housing, 27 lower side housing, 28 side housing, 29 decorative block, 291 pressing column, 30 bottom cover, 31 top cover, 32 key switch board, 321 key switch, 33 compression spring, 34 first rotating shaft, 35 first torsion spring, 36 second rotating shaft, 37 second torsion spring, 38 third rotating shaft, 39 transparent block, 40 elastic electrode, 41 first contact plate, 42 second contact plate, 43 nozzle sealing ring, 44 PCB, 441 Universal Serial Bus (USB) charging interface, 45 light guide strip, 46 second support, 47 cell, 48 spring.

DETAILED DESCRIPTION OF EMBODIMENTS

Embodiment 1 of Electronic Cigarette

As shown in FIGS. 1 to 12, Embodiment 1 of an ultrasonic atomization type electronic cigarette includes an ultrasonic atomizer I, the ultrasonic atomizer I includes an ultrasonic atomization sheet 1. The operating frequency of the ultrasonic atomization sheet 1 is 1.7 MHz to 2.4 MHz. The ultrasonic atomization sheet 1 is a solid piezoelectric ceramic ultrasonic atomization sheet 1. The angle between the ultrasonic atomization sheet 1 and the central axis of the electronic cigarette is $\alpha$, and the value of $\alpha$ is 5° to 85°, preferably 15° to 55°.

When the electronic cigarette is used or stored, the ultrasonic atomization sheet 1 is not immersed in cigarette liquid, so smoke is emitted fast, the smoke volume is large, and the user hardly sucks the cigarette liquid.

The electronic cigarette further includes an electronic cigarette housing II and a nozzle 3 connected to the electronic cigarette housing II. The electronic cigarette housing II is provided with an air inlet groove 20, a first support 21 is arranged in the electronic cigarette housing II, a receiving cavity 211 for receiving the ultrasonic atomizer I is formed in the first support 21, and the angle between the central axis of the receiving cavity 211 and the central axis of the electronic cigarette is $\alpha$. The air inlet groove 20, an atomization surface of the ultrasonic atomization sheet 1, and the nozzle 3 are connected in sequence.

After the ultrasonic atomizer I is assembled inside the electronic cigarette housing II, since the receiving cavity 211 of the first support 21 has an inclination angle α, the ultrasonic atomizer I also has an inclination angle α inside the electronic cigarette housing II, and the ultrasonic atomization sheet 1 is inclined. Since the ultrasonic atomizer I is assembled inside the electronic cigarette housing II, the user does not directly hold the atomizer housing when in use, scalding the hand or touching the cigarette liquid is unlikely to occur, and the ultrasonic atomizer I is unlikely to be damaged.

A cavity 22 is formed between the outer side wall of the first support 21 and the inner side wall of the electronic cigarette housing II, the air inlet groove 20, the cavity 22, an air groove 212 on the inner side wall of the receiving cavity 211, the atomization surface of the ultrasonic atomization sheet 1, and the nozzle 3 are connected in sequence.

Air enters the cavity 22 inside the electronic cigarette housing II from the air inlet groove 20, then enters the ultrasonic atomizer I through the air groove 212 on the receiving cavity 211, takes away the smoke generated by the ultrasonic atomization sheet 1, and enters the user's mouth through the nozzle 3. Since the ultrasonic atomizer I is not in direct contact with the electronic cigarette housing II, the hand can be further prevented from being scalded, and the air can also take away part of heat.

The ultrasonic atomizer I is detachably connected to the first support 21, and further includes an upper cover assembly III capable of opening the receiving cavity 211, and a locking structure IV capable of locking the upper cover assembly III.

The ultrasonic atomizer I is used as a separate component, and can be conveniently replaced after used, thus ensuring ease of use and stability of the flavor of the cigarette liquid.

The upper cover assembly III includes a flip cover 23 and a gasket 24 that can press the ultrasonic atomizer I, the gasket 24 and the nozzle 3 are respectively located at two ends of the flip cover 23, one side of the flip cover 23 is pivotally connected to the first support 21, and the other side of the flip cover 23 is provided with a locking groove 231; the locking structure IV includes a rotating buckle 25, the rotating buckle 25 is pivotally connected to the first support 21, and the rotating buckle 25 is provided with a locking buckle 251 that matches the locking groove 231. The upper cover assembly III further includes a nozzle sealing ring 43 sleeved between the flip cover 23 and the nozzle 3.

The closure of the flip cover 23 is fixed by the rotating buckle 25 arranged on the first support 21. After the ultrasonic atomizer I is assembled into the receiving cavity 211, the gasket 24 fixed on the flip cover 23 presses the ultrasonic atomizer I, thereby good contact of the electrodes will not affected by shaking, ensuring normal transmission of airflow and avoiding blow-by and air leakage at the same time. The lower side of the rotating buckle 25 is pressed to disengage the locking buckle 251 from the locking groove 231 of the flip cover 23, and the flip cover 23 is opened, so that the ultrasonic atomizer I can be taken out.

The electronic cigarette housing II includes an upper side housing 26 and a lower side housing 27 which are oppositely arranged, and a side housing 28 and a decorative block 29 which are oppositely arranged; the upper side housing 26 is connected to the lower side housing 27 through the side housing 28, the bottom of the lower side housing 27 is provided with a bottom cover 30 for sealing, the top of the upper side housing 26 is provided with a top cover 31 for sealing, one end of the decorative block 29 is pivotally connected to the first support 21, and the other end of the decorative block 29 is clamped in the upper side housing 26; a key switch board 32 is arranged in the electronic cigarette housing II, a key switch 321 is arranged on the key switch board 32, and a pressing column 291 in contact with the key switch 321 is arranged on the decorative block 29.

The whole decorative block 29 is pressed, and the pressing column 291 on the decorative block 29 drives the key switch 321 to press down, thus completing the switching operation. Compared with the conventional single-finger pressing, the holding and pressing contact area is larger, the holding and pressing are convenient, the operation is reliable, and the user experience is good.

The electronic cigarette further includes a compression spring 33, the pressing column 291 is in contact with the key switch 321 after passing through the first support 21, one end of the compression spring 33 abuts against the inner side wall of the decorative block 29, and the other end of the compression spring 33 abuts against the outer side wall of the first support 21.

When the user holds and presses the switch, the compression spring 33 always has an outward thrust, which can increase user's strength of holding and pressing the switch, increase the hand feel, and improve the product quality.

One side of the flip cover 23 is pivotally connected to the first support 21 through a first rotating shaft 34, and a first torsion spring 35 is sleeved on the first rotating shaft 34.

When the flip cover 23 of the upper cover assembly III is disengaged from a buckling position of the locking buckle 251 of the rotating buckle 25, the torque of the first torsion spring 35 automatically opens the upper cover assembly III to facilitate the insertion and removal of the ultrasonic atomizer I.

The rotating buckle 25 is pivotally connected to the first support 21 through a second rotating shaft 36, and a second torsion spring 37 is sleeved on the second rotating shaft 36.

After the rotating buckle 25 locks the flip cover 23, the torque of the second torsion spring 37 can press the flip cover 23 to ensure the locking reliability.

One end of the decorative block 29 is pivotally connected to the first support 21 through a third rotating shaft 38.

The decorative block 29 is fixed on the first support 21 by the third rotating shaft 38, so that the decorative block 29 can be properly held and pressed, and supported by enough force without shaking. The top of the decorative block 29 has a longer holding and pressing stroke, and the bottom has a shorter holding stroke, that is, the holding and pressing stroke is gradually increased from the bottom to the top.

The electronic cigarette housing II further includes a transparent block 39 opposite to a central through region of the decorative block 29, the inner side wall of the transparent block 39 fits the outer side wall of the decorative block 29, and the transparent block 39 is buckled with the first support 21.

The whole transparent block 39 is held and pressed, and the pressing column 291 on the decorative block 29 drives the key switch 321 to press down, thus completing the switching operation. Since the coverage of the transparent block 39 is large, the user can hold and press conveniently.

The top end of the decorative block 29 is provided with a buckling position, and the buckling position is directly inserted into the first support 21 and a groove on the upper side housing 26. When the user presses the transparent block 39 and then releases it, the decorative block 29 is reset outward under the elastic force of the compression spring 33, and the decorative block 29 and the transparent block 39 are blocked by the upper side housing 26 to prevent them from falling out of the upper side housing 26.

The air inlet groove 20 is formed at a peripheral edge of the decorative block 29.

Air enters the cavity 22 inside the electronic cigarette from the air inlet groove 20 on the periphery of the decorative block 29, then enters the ultrasonic atomizer I through the air groove 212 on the receiving cavity 211, takes away the smoke generated by the ultrasonic atomization sheet 1, and enters the user's mouth through the nozzle 3.

The ultrasonic atomizer I includes an atomization sleeve 5, the ultrasonic atomization sheet 1 is arranged in the atomization sleeve 5, a cigarette liquid cavity 6 and a liquid guide structure for connecting the cigarette liquid cavity 6 with the ultrasonic atomization sheet 1 are further arranged in the atomization sleeve 5, and the liquid guide structure includes a liquid guide body 4; the liquid guide body 4 includes a first liquid guide layer 401 and a second liquid guide layer 402, and a side of the first liquid guide layer 401 is sandwiched between a side of the second liquid guide layer 402 and the atomization surface of the ultrasonic atomization sheet 1.

The ultrasonic atomizer I further includes a threaded sleeve support 10, a negative contact plate 11, an atomization seat 12, a negative threaded sleeve 13, a positive conductive terminal 14 and a terminal block 15, wherein the ultrasonic atomization sheet 1 is placed in the atomization sleeve 5 and is perpendicular to the axis of the atomization sleeve 5, the atomization seat 12 is arranged in the top of the negative threaded sleeve 13, the top of the outer side wall of the negative threaded sleeve 13 is screwed to the bottom of the inner side wall of the threaded sleeve support 10, the bottom end of the atomization sleeve 5 is sleeved outside the threaded sleeve support 10, the terminal block 15 is arranged in the bottom of the negative threaded sleeve 13, and the positive conductive terminal 14 passes through the terminal block 15 and abuts against a positive conductive layer of the ultrasonic atomization sheet 1; one end of the negative contact plate 11 fits a negative conductive layer of the ultrasonic atomization sheet 1, and the other end of the negative contact plate 11 passes through the atomization seat 12 and is in contact with the negative threaded sleeve 13; an elastic electrode 40 abutting against the positive conductive terminal 14 is arranged on the bottom surface of the receiving cavity 211, and the elastic electrode 40 is fixedly connected to the key switch board 32 through a first contact plate 41; a second contact plate 42 abutting against the negative threaded sleeve 13 is arranged on the side wall of the receiving cavity 211.

The positive conductive layer of the ultrasonic atomization sheet 1 is arranged on the bottom surface, the negative conductive layer of the ultrasonic atomization sheet 1 extends from the top surface along the side of the ultrasonic atomization sheet 1 to the bottom surface of the ultrasonic atomization sheet 1, thus, in this embodiment, the positive conductive terminal 14 abuts against the positive conductive layer on the bottom surface of the ultrasonic atomization sheet 1, and the negative contact plate 11 fits the negative conductive layer on the bottom surface of the ultrasonic atomization sheet 1.

The elastic electrode 40 and the second contact plate 42 are arranged at the bottom of the receiving cavity 211 of the first support 21, and have a pushing/clamping effect on the removal/insertion of the ultrasonic atomizer I, thereby facilitating the insertion and removal of the ultrasonic atomizer I.

The electrical conductivity of the present invention is reliable: the elastic electrode 40 is fixed in the first support 21, and is clamped by the first contact plate 41 arranged on the key switch board 32 to conduct anode current; the second contact plate 42 is fixed on the first support 21, and when the ultrasonic atomizer I is assembled into the receiving cavity 211 of the first support 21, the metal housing (negative threaded sleeve 13) of the ultrasonic atomizer I is connected to the second contact plate 42 to conduct cathode current.

The ultrasonic atomizer I further includes an air outlet tube 7, an air tube support 8, an atomization cover 19 and an atomization support 9, wherein the top end of the air outlet tube 7 is fixedly connected to the atomization cover 19 and communicates with the nozzle 3, the bottom end of the air outlet tube 7 extends into the inner cavity of the liquid guide body 4, the top end of the side wall of the air tube support 8 is provided with an air inlet 81, the air outlet tube 7 is sleeved in the air tube support 8, and an air inlet channel 16 for connecting the air inlet 81 with the air outlet tube 7 is formed between the inner side wall of the air tube support 8 and the outer side of the air outlet tube 7; the air inlet groove 20, the cavity 22, the air groove 212 on the inner side wall of the receiving cavity 211, the air inlet 81, the air inlet channel 16, the atomization surface of the ultrasonic atomization sheet 1, the air outlet tube 7, and the nozzle 3 are connected in sequence; the bottom of the outer side wall of the air tube support 8 is screwed to the top of the inner side wall of the atomization support 9, the side wall of the liquid guide body 4 is sleeved outside the side wall of the atomization support 9, the liquid reservoir 2 is sleeved with a threaded sleeve support 10, and the threaded sleeve support 10 is provided with a liquid passing hole for connecting the cigarette liquid cavity 6 with the liquid reservoir 2.

Figure 2:
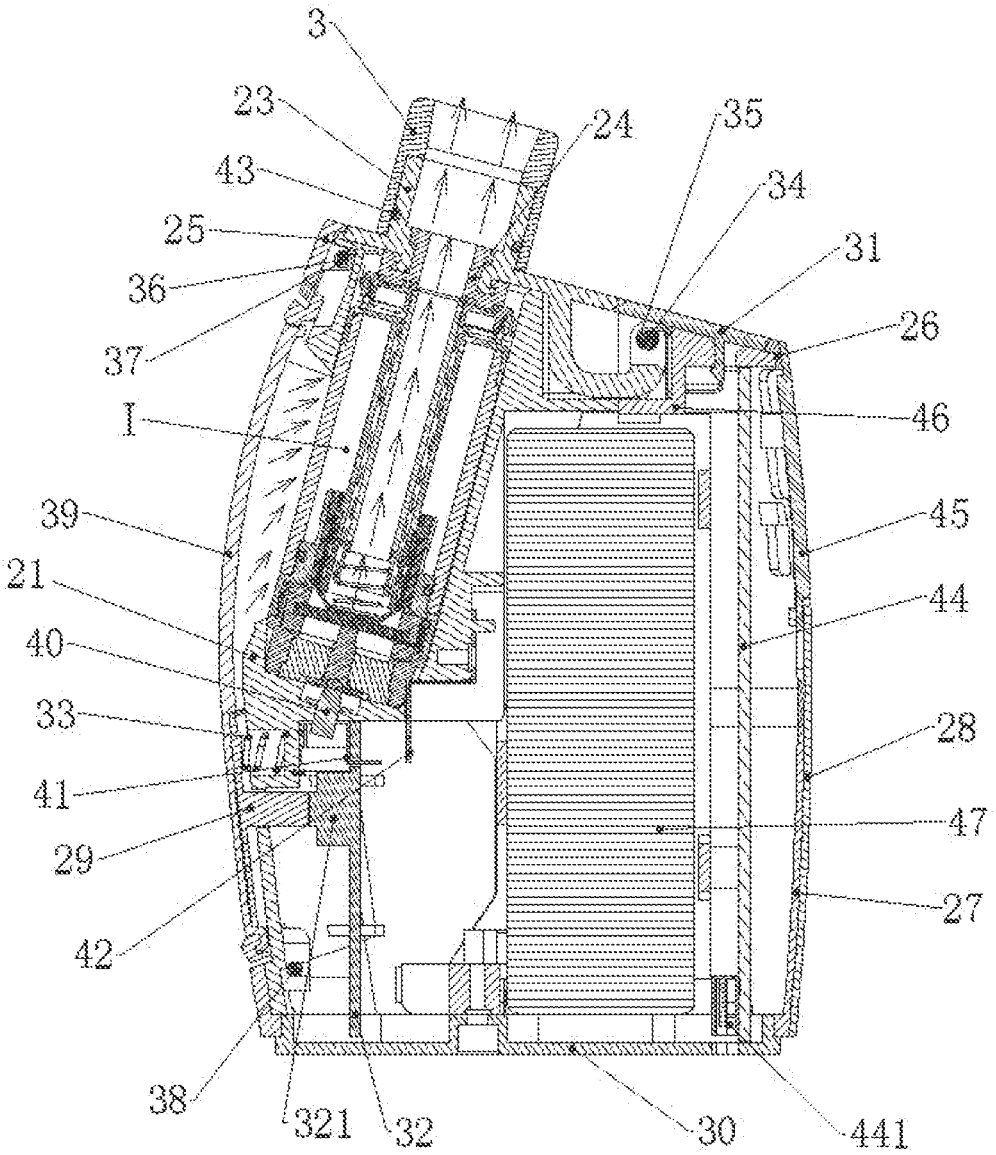
FIG. 2 is a front sectional view of FIG. 1.
Figure 3:
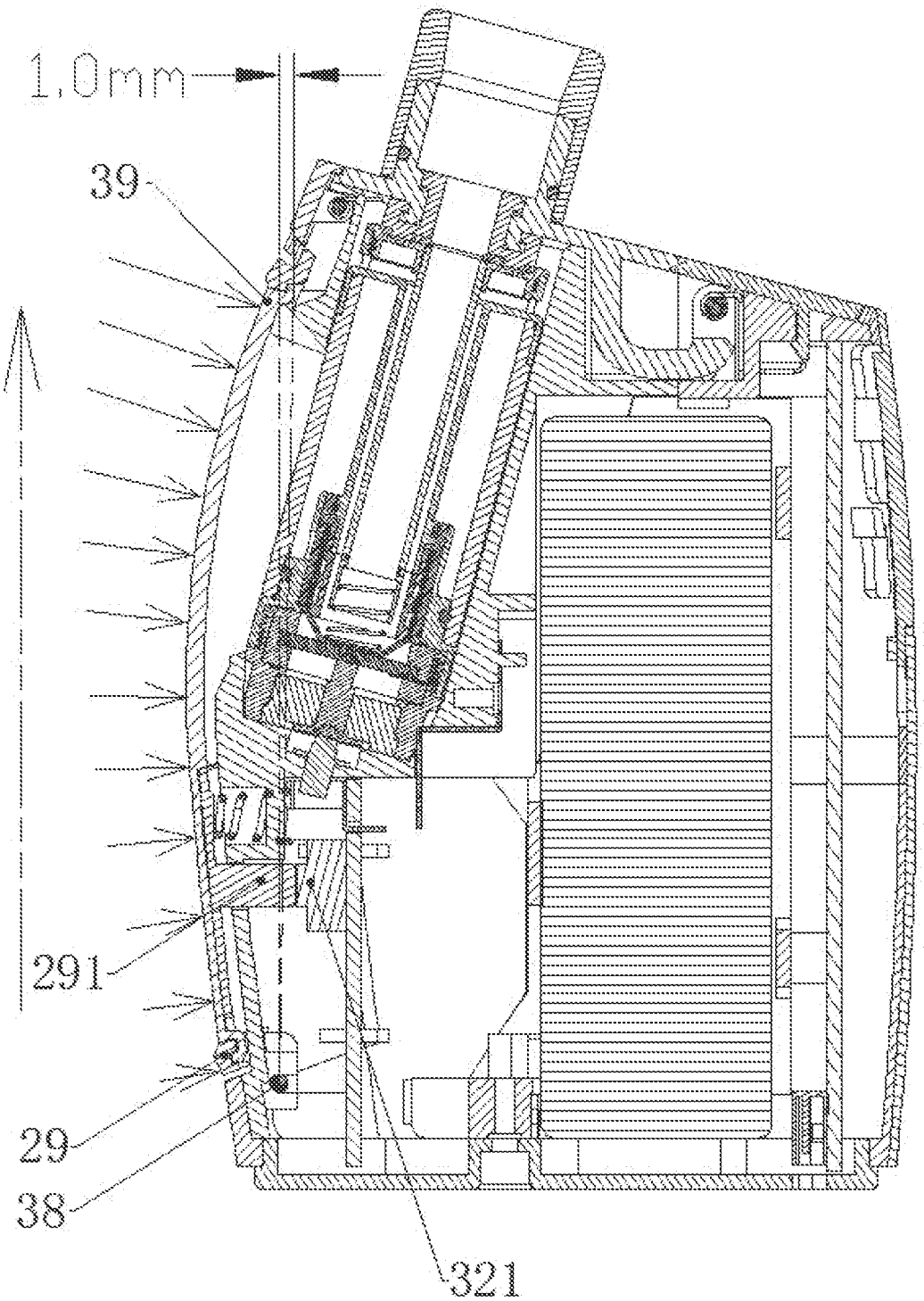
FIG. 3 is a schematic view of holding and pressing operation of FIG. 1.
Figure 4:
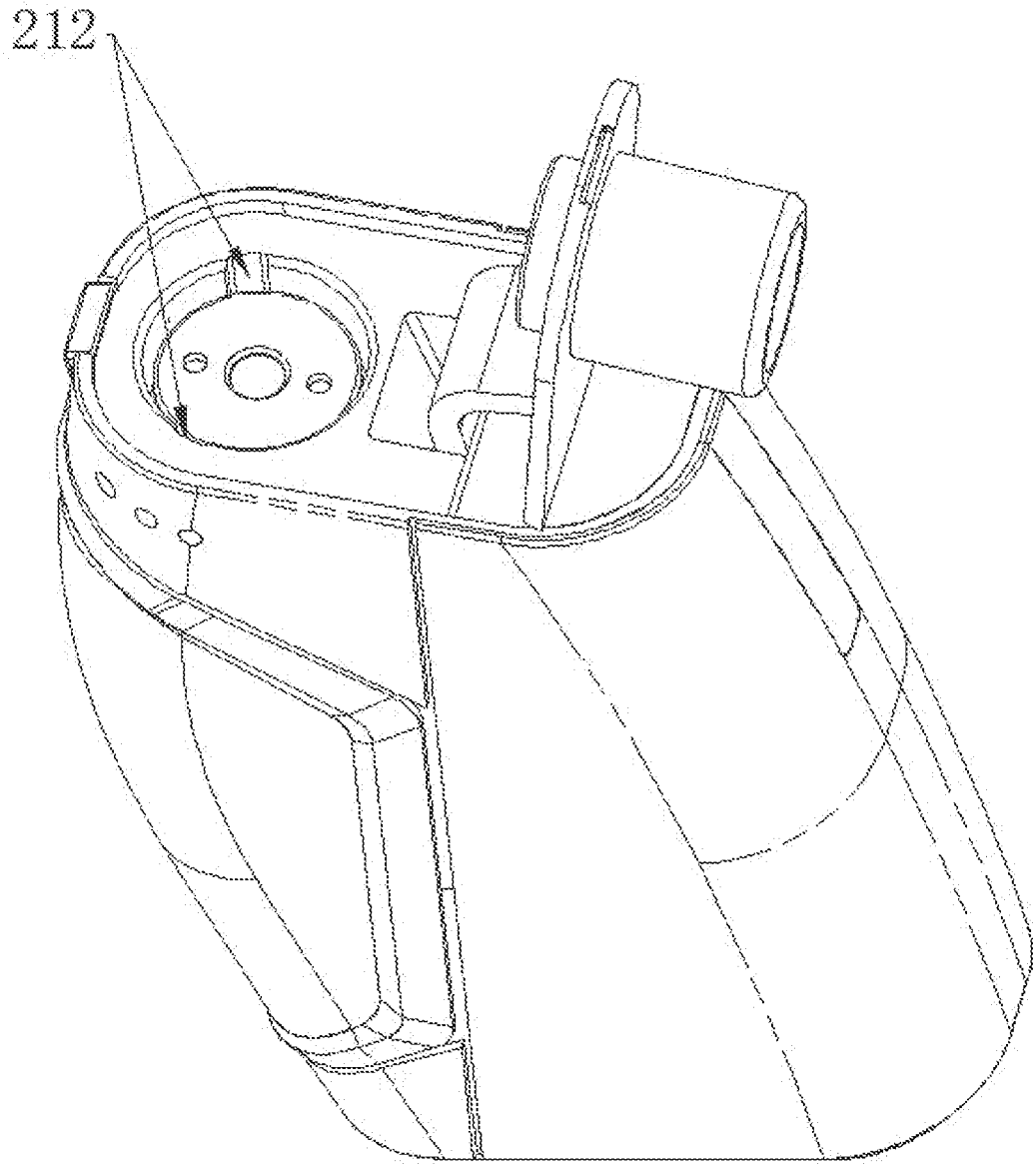
FIG. 4 is a schematic structural view of FIG. 1 after an upper cover assembly is opened.
Figure 5:
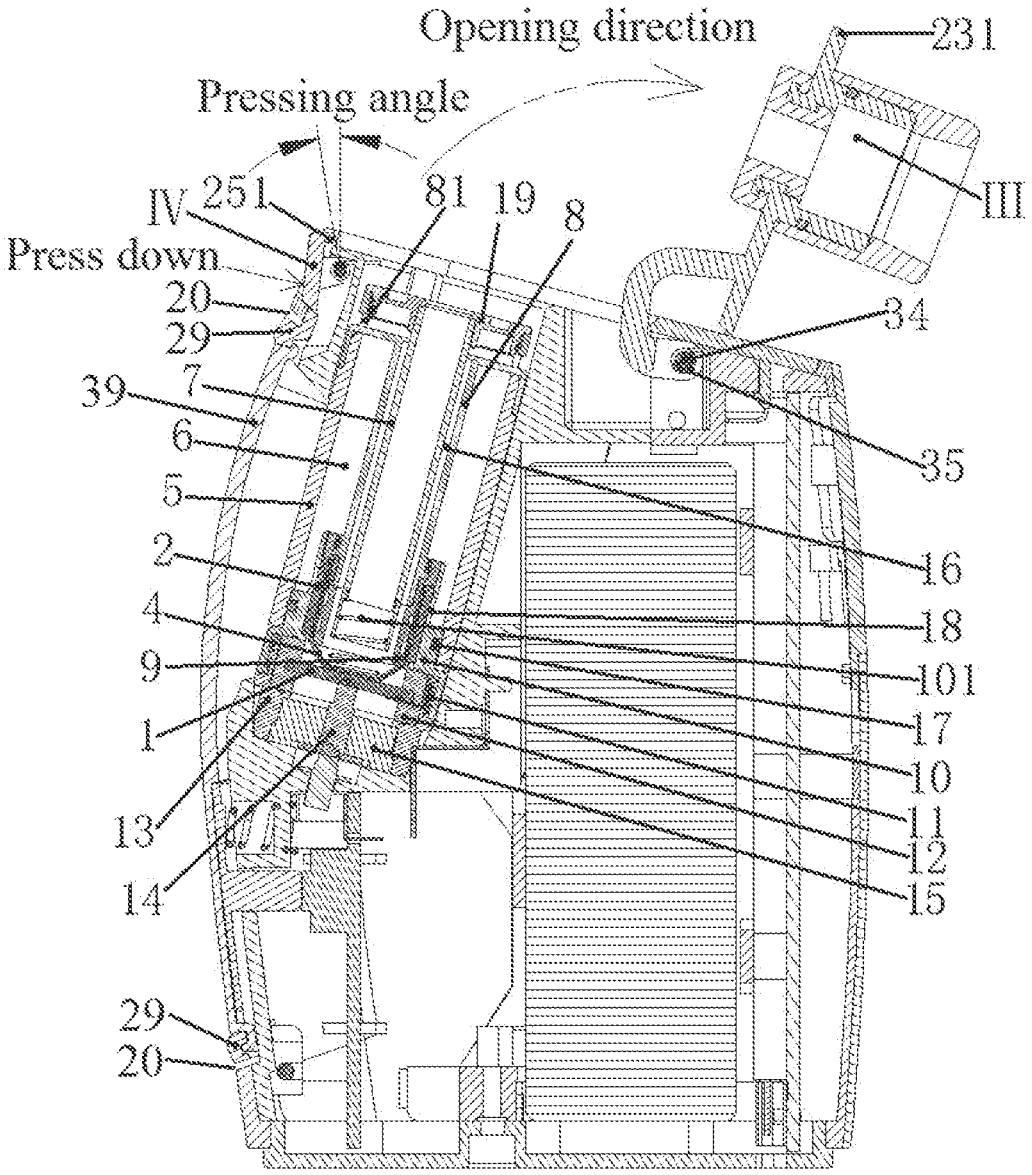
FIG. 5 is a front sectional view of FIG. 4.
Figure 6:
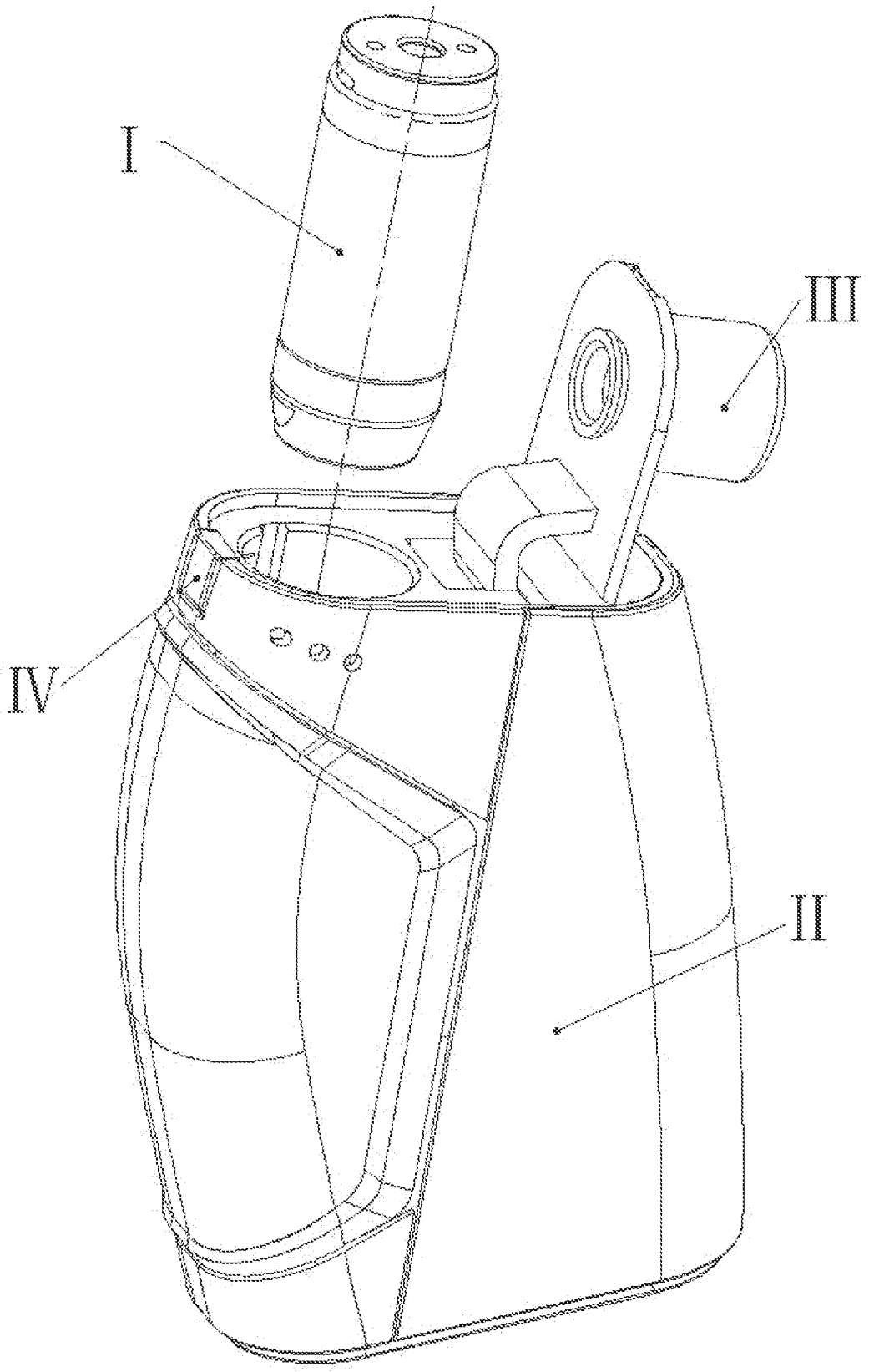
FIG. 6 is an exploded view of components in FIG. 4.
Figure 7:
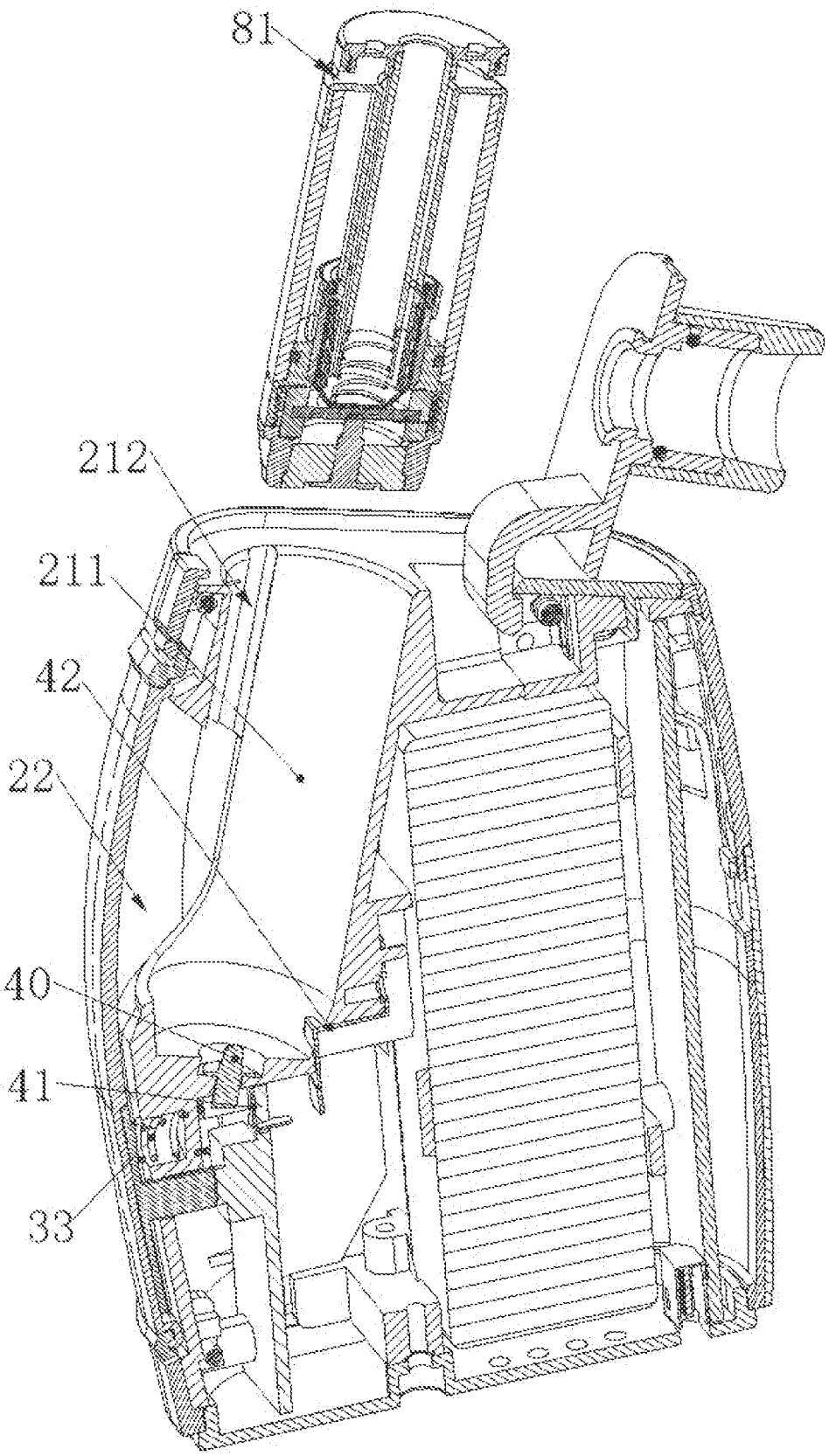
FIG. 7 is an oblique sectional view of FIG. 6.
Figure 8:
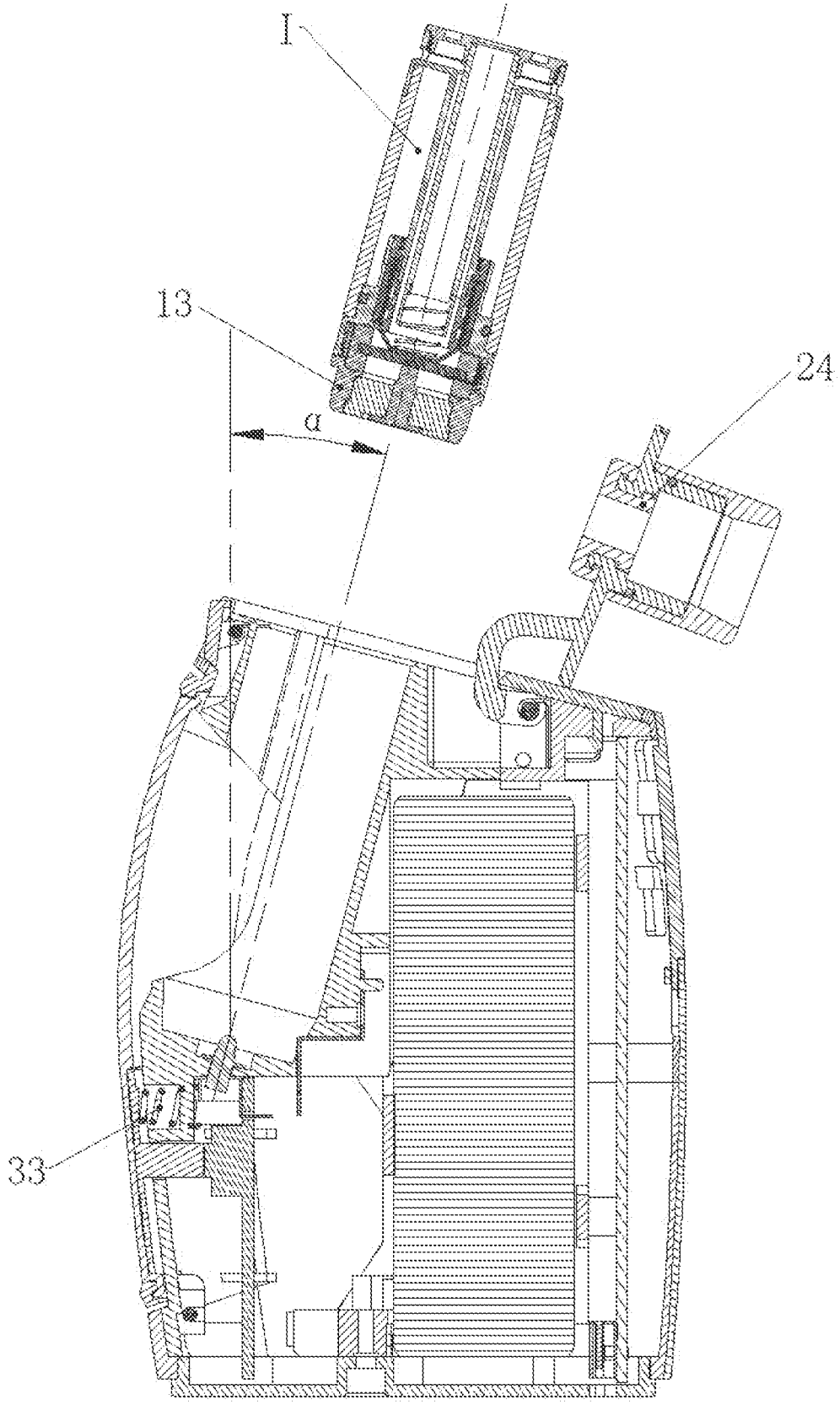
FIG. 8 is a front sectional view of FIG. 7.
Figure 9:
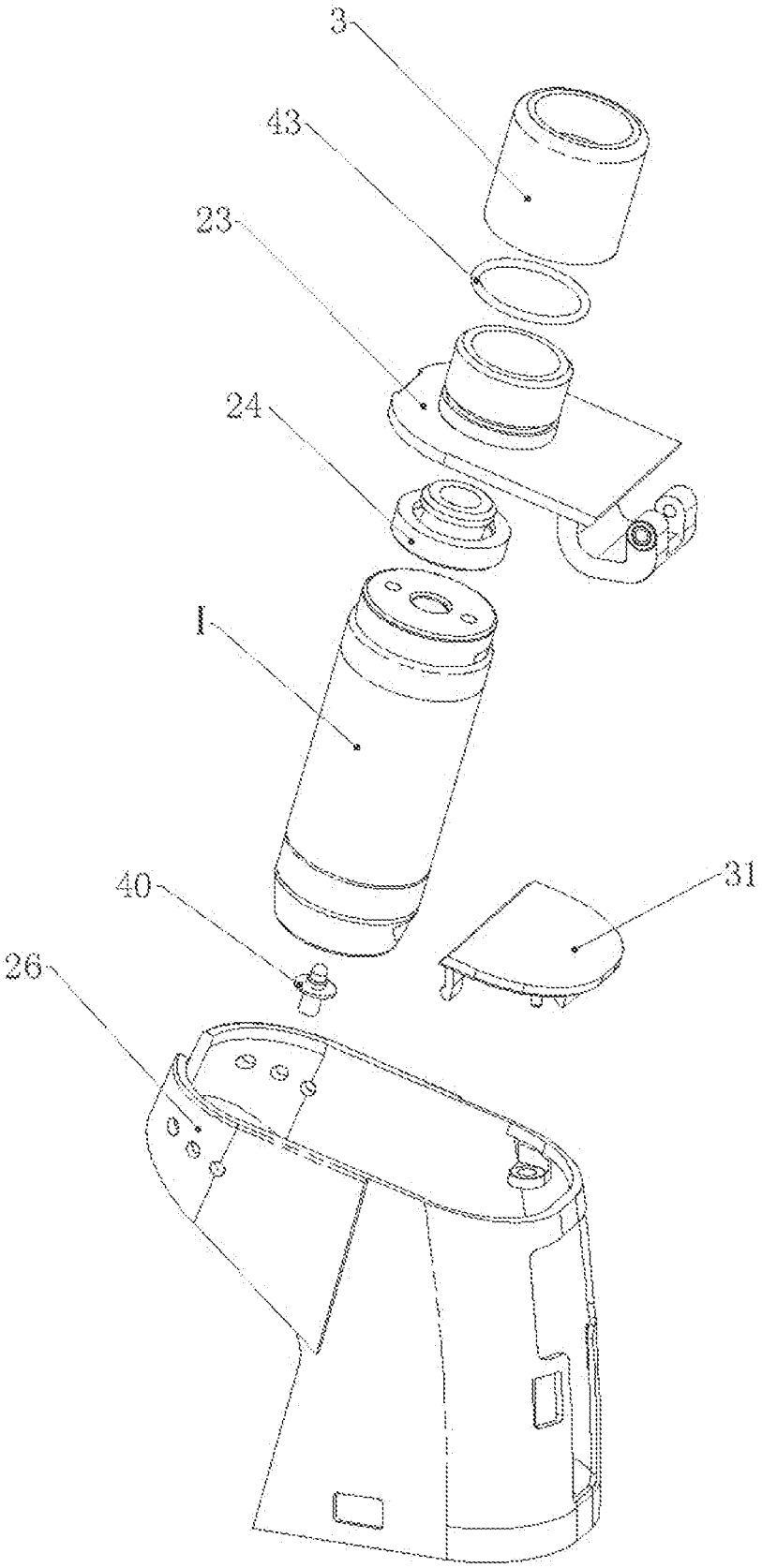
FIG. 9 is the upper half of an exploded view of FIG. 1.
Figure 10:
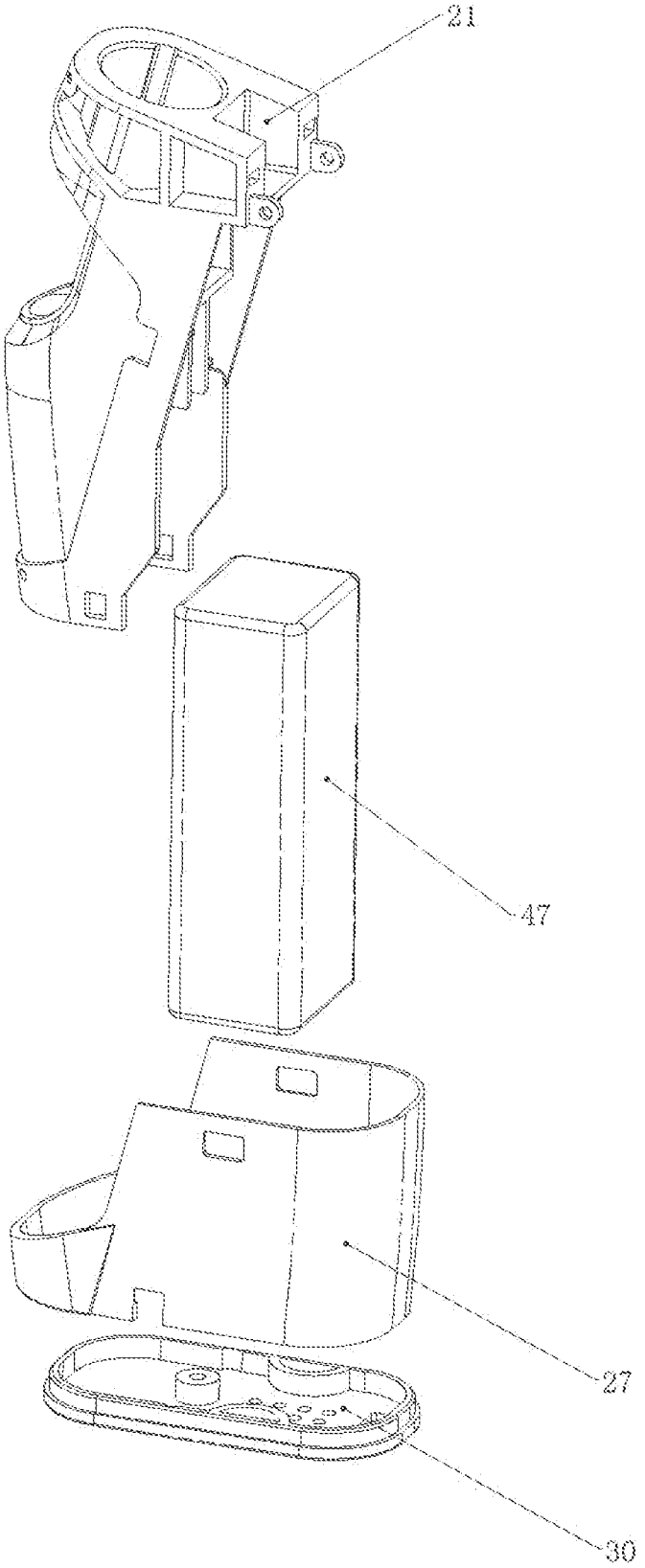
FIG. 10 is the lower half of the exploded view of FIG. 1.
Figure 11:
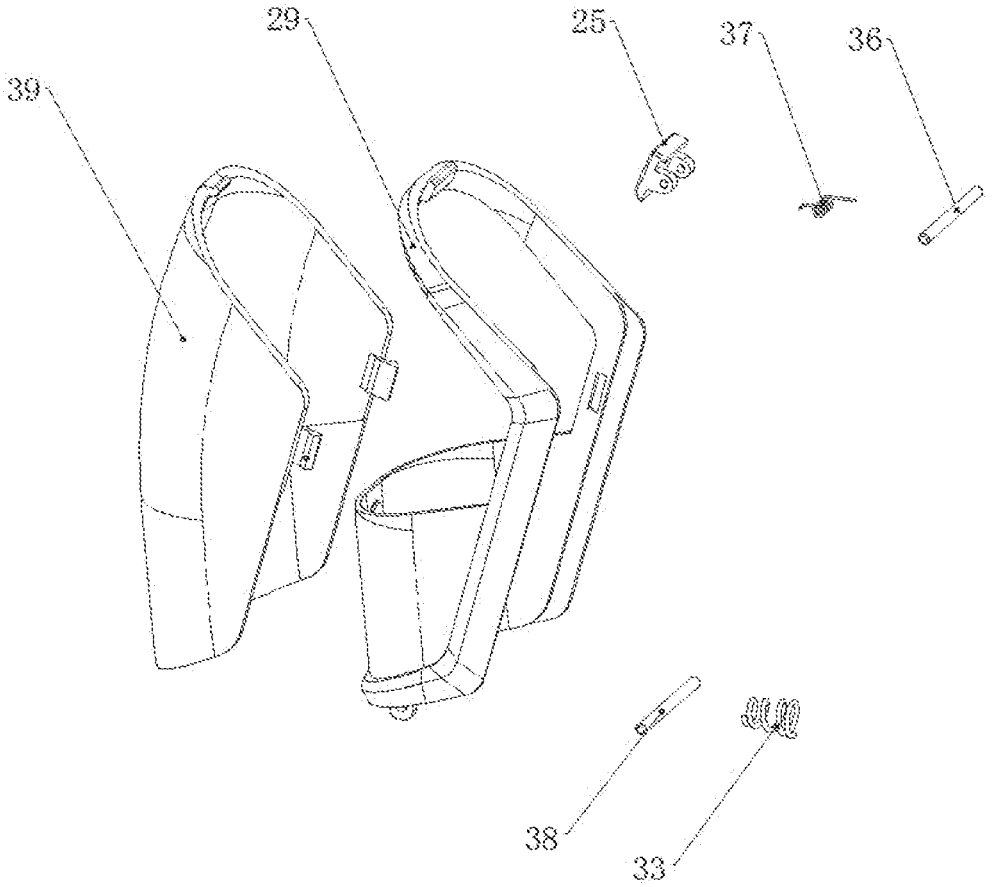
FIG. 11 is the left half of the exploded view of FIG. 1.
Figure 12:
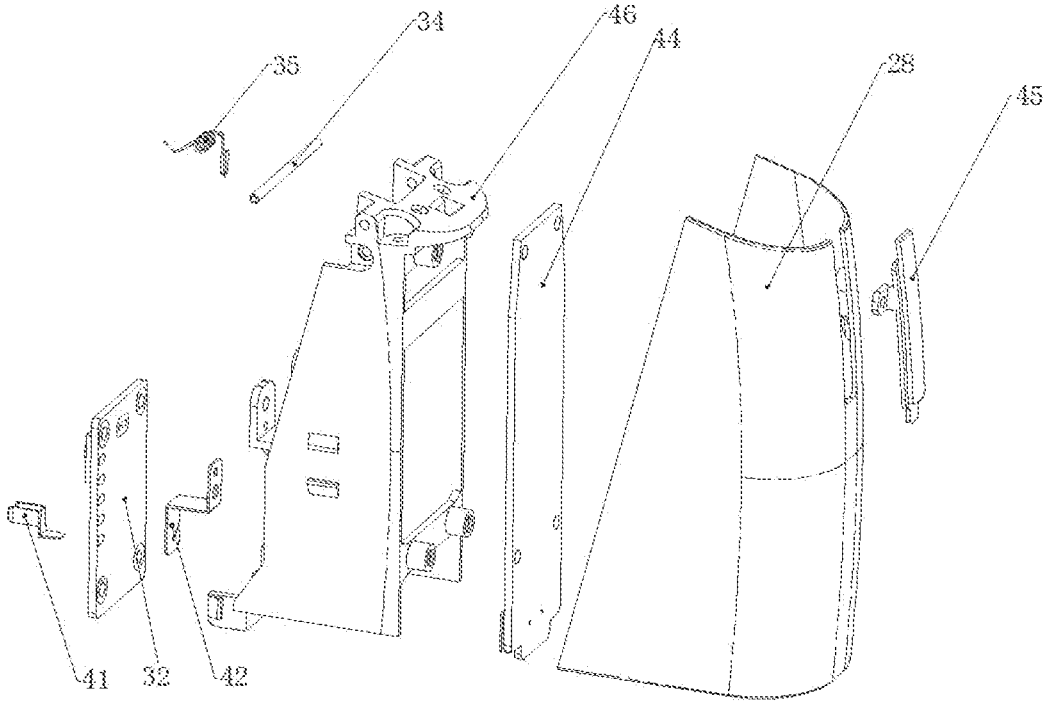
FIG. 12 is the right half of the exploded view of FIG. 1.

Air enters the air inlet channel 16 from the air groove 212 in the receiving cavity 211 through the air inlet 81, then enters the ultrasonic atomization sheet 1, takes the smoke atomized by the ultrasonic atomization sheet 1 away from the air outlet tube 7, and reaches the user's mouth through the nozzle 3. The direction indicated by the arrows in FIG. 2 is the direction of the air flow.

The ultrasonic atomizer I further includes a cotton pressing spring 18, the top end of the cotton pressing spring 18 extends into the air outlet tube 7 and abuts against the bottom end of the inner side wall of the air outlet tube 7, and the bottom end of the cotton pressing spring 18 abuts against the inner bottom surface of the liquid guide body 4.

The cigarette liquid cavity 6 is formed by the outer side wall of the air tube support 8, the inner side wall of the atomization sleeve 5, and the outer side wall of the threaded sleeve support 10.

A sealing ring 17 for sealing cigarette liquid is further arranged between the outer side wall of the threaded sleeve support 10 and the inner side wall of the atomization sleeve 5.

A PCB 44 is further arranged in the electronic cigarette housing II, and a light guide strip 45 corresponding to the PCB 44 is arranged on the upper side housing 26.

A second support 46 is further arranged in the electronic cigarette housing II, a cell 47 is arranged in a placement cavity of the second support 46, and the PCB 44 is fixed to the second support 46. The PCB 44 is provided with a USB charging interface 441.

Figure 13:
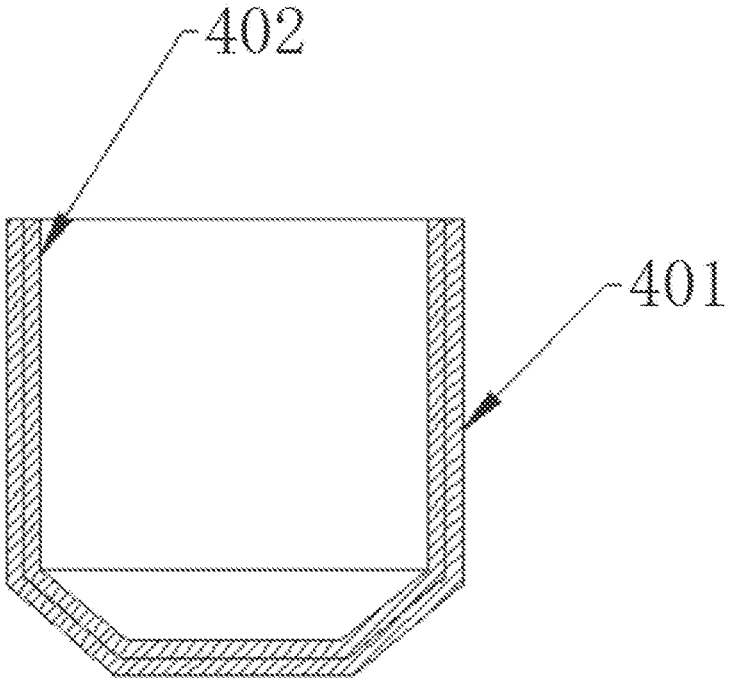
FIG. 13 is a schematic structural view of Embodiment 1 of a liquid guide body.

As shown in FIG. 13, the liquid guide body in Embodiment 1 includes a first liquid guide layer 401 and a second liquid guide layer 402, and a side of the first liquid guide layer 401 is sandwiched between a side of the second liquid guide layer 402 and the atomization surface of the ultrasonic atomization sheet 1.

The first liquid guide layer 401 and the second liquid guide layer 402 are both cup-shaped, the first liquid guide layer 401 is wrapped outside the second liquid guide layer 402, and the bottom surface of the first liquid guide layer 401 is sandwiched between the bottom surface of the second liquid guide layer 402 and the ultrasonic atomization sheet 1.

Figure 14:
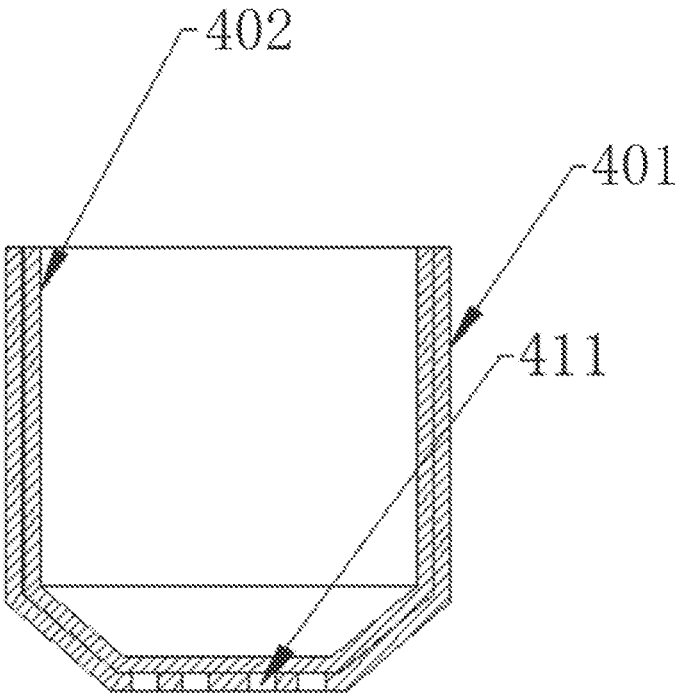
FIG. 14 is a schematic structural view of Embodiment 2 of the liquid guide body.

As shown in FIG. 14, the liquid guide body in Embodiment 2 includes a first liquid guide layer 401 and a second liquid guide layer 402, and a side of the first liquid guide layer 401 is sandwiched between a side of the second liquid guide layer 402 and the atomization surface of the ultrasonic atomization sheet 1.

The first liquid guide layer 401 and the second liquid guide layer 402 are both cup-shaped, the first liquid guide layer 401 is wrapped outside the second liquid guide layer 402, and the bottom surface of the first liquid guide layer 401 is sandwiched between the bottom surface of the second liquid guide layer 402 and the ultrasonic atomization sheet 1. The bottom surface of the first liquid guide layer 401 is provided with a through hole 411 for connecting the bottom surface of the second liquid guide layer 402 with the atomization surface of the ultrasonic atomization sheet 1.

Figure 15:
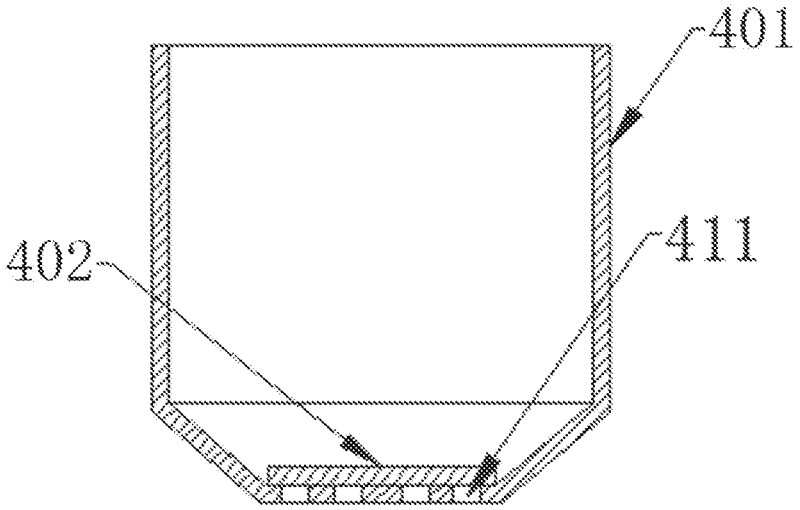
FIG. 15 is a schematic structural view of Embodiment 3 of the liquid guide body.

The first liquid guide layer 401 is made of an ultra-high wear-resistant material (e.g., ceramics, etc.), and the second liquid guide layer 402 is made of liquid guide cotton. As shown in FIG. 15, the liquid guide body in Embodiment 3 includes a first liquid guide layer 401 and a second liquid guide layer 402, and a side of the first liquid guide layer 401 is sandwiched between a side of the second liquid guide layer 402 and the atomization surface of the ultrasonic atomization sheet 1.

The first liquid guide layer 401 is cup-shaped, the second liquid guide layer 402 is flaky, and the second liquid guide layer 402 covers the inner bottom surface of the first liquid guide layer 401. The bottom surface of the first liquid guide layer 401 is provided with a through hole 411 for connecting the bottom surface of the second liquid guide layer 402 with the atomization surface of the ultrasonic atomization sheet 1.

The second liquid guide layer 402 is a high-density filter screen.

Figure 16:
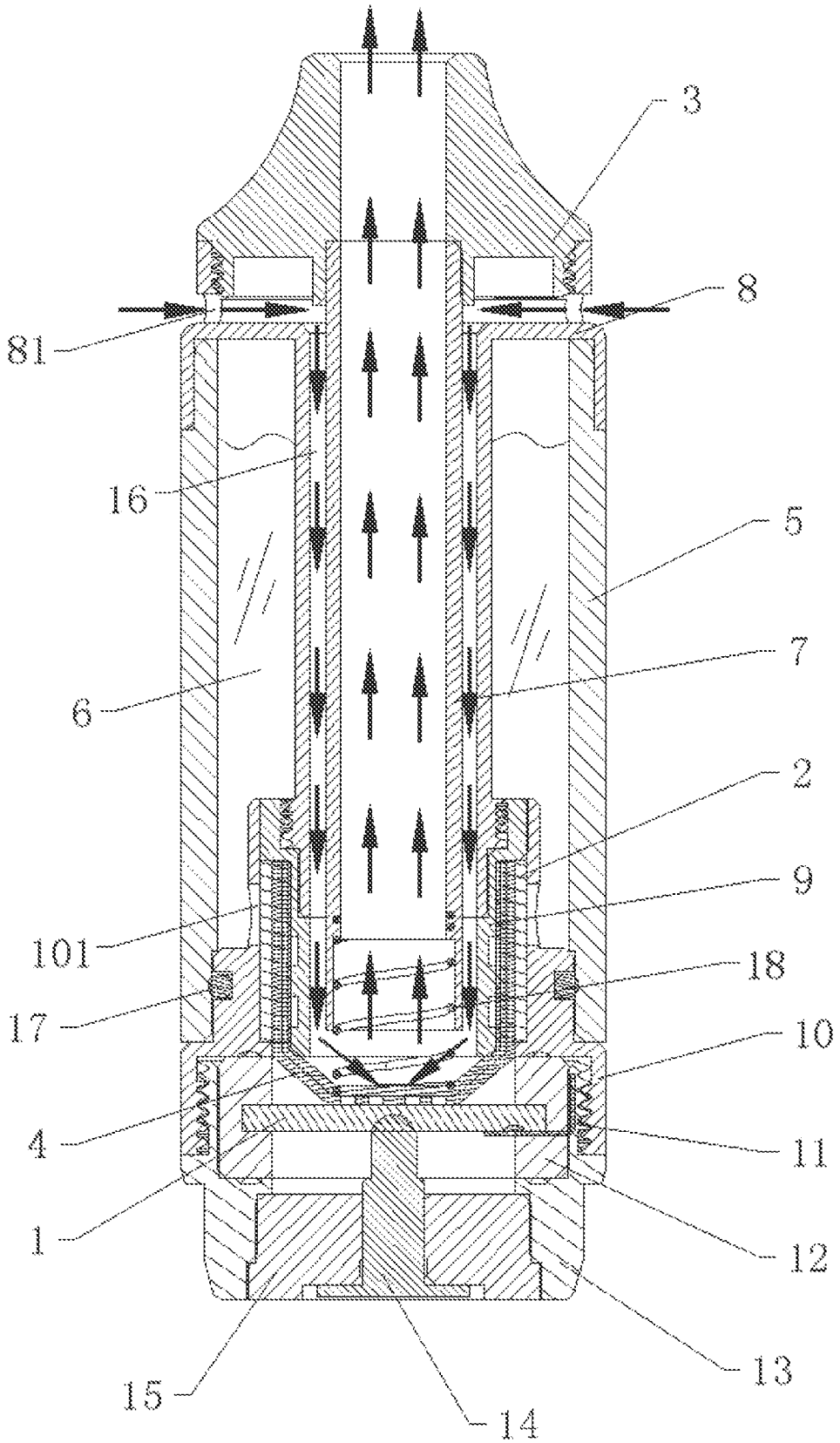
FIG. 16 is a main cross-sectional view of Embodiment 1 of an atomizer.
Figure 17:
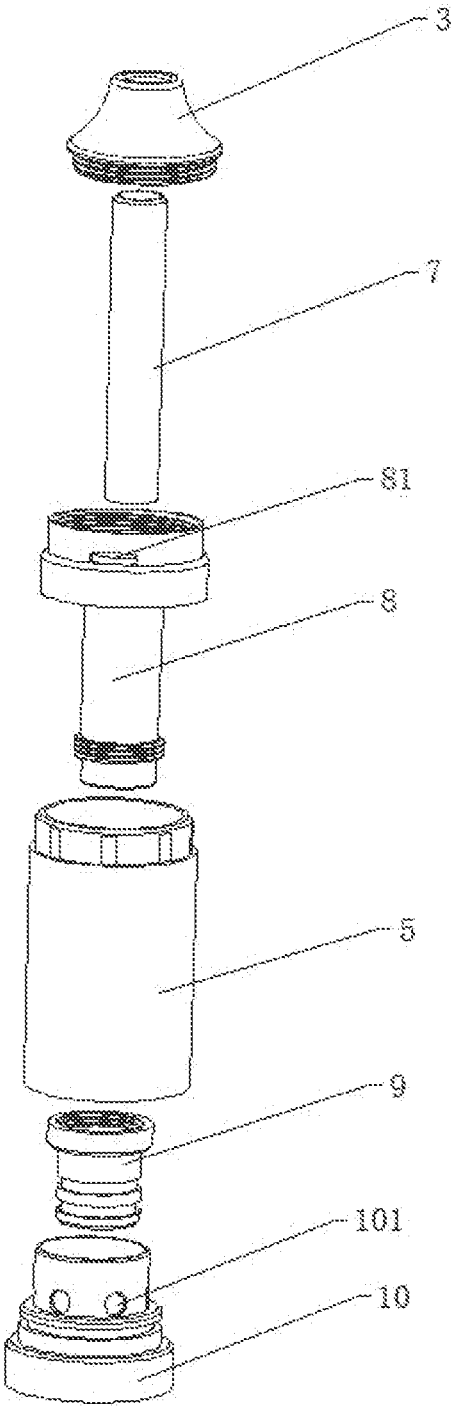
FIG. 17 is the upper half of an exploded view of FIG. 16.
Figure 18:
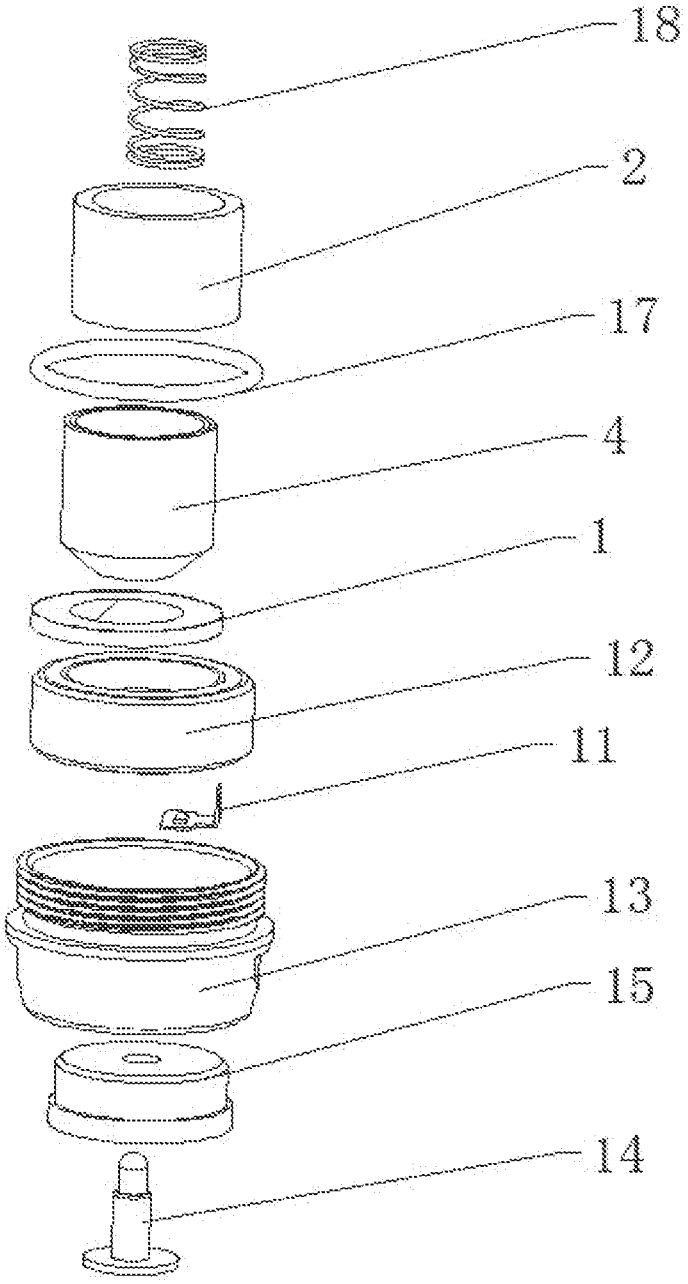
FIG. 18 is the lower half of the exploded view of FIG. 16.

As shown in FIG. 16 to FIG. 18, the ultrasonic electronic cigarette atomizer in an embodiment includes an atomization sleeve 5, a cigarette liquid cavity 6, an ultrasonic atomization sheet 1, and a liquid guide structure for connecting the cigarette liquid cavity 6 with the ultrasonic atomization sheet 1 are disposed in the atomization sleeve 5, and the liquid guide structure includes the liquid guide body 4 in Embodiment 2. The liquid guide structure further includes a liquid reservoir 2 wrapped on the outer side wall of the first liquid guide layer 401, and the outer side wall of the liquid reservoir 2 is communicated with the cigarette liquid cavity 6. The ultrasonic atomization sheet 1 is a solid piezoelectric ceramic sheet.

The ultrasonic electronic cigarette atomizer further includes an air outlet tube 7, an air tube support 8, a nozzle 3, an atomization support 9, a threaded sleeve support 10, a negative contact plate 11, an atomization seat 12, a negative threaded sleeve 13, a positive conductive terminal 14 and a terminal block 15, wherein the ultrasonic atomization sheet 1 is perpendicular to the axis of the atomization sleeve 5, the top end of the air outlet tube 7 is communicated with the nozzle 3, the bottom end of the air outlet tube 7 extends into the inner cavity of the liquid guide body 4, the top end of the side wall of the air tube support 8 is provided with an air inlet 81, the air outlet tube 7 is sleeved in the air tube support 8, and an air inlet channel 16 for connecting the air inlet 81 with the air outlet tube 7 is formed between the inner side wall of the air tube support 8 and the outer side of the air outlet tube 7; the bottom of the outer side wall of the air tube support 8 is screwed to the top of the inner side wall of the atomization support 9, the side wall of the liquid guide body 4 is sleeved outside the side wall of the atomization support 9, the external of the liquid reservoir 2 is sleeved with a threaded sleeve support 10, the threaded sleeve support 10 is provided with a liquid passing hole 101 for connecting the cigarette liquid cavity 6 with the liquid reservoir 2, the atomization seat 12 is arranged in the top of the negative threaded sleeve 13, the top of the outer side wall of the negative threaded sleeve 13 is screwed to the bottom of the inner side wall of the threaded sleeve support 10, the terminal block 15 is arranged in the bottom of the negative threaded sleeve 13, and the positive conductive terminal 14 passes through the terminal block 15 and abuts against the positive conductive layer of the ultrasonic atomization sheet 1; one end of the negative contact plate 11 fits the negative conductive layer of the ultrasonic atomization sheet 1, and the other end of the negative contact plate 11 passes through the atomization seat 12 and is in contact with the negative threaded sleeve 13.

The positive conductive layer of the ultrasonic atomization sheet 1 is arranged on the bottom surface, the negative conductive layer of the ultrasonic atomization sheet 1 extends from the top surface along the side of the ultrasonic atomization sheet 1 to the bottom surface of the ultrasonic atomization sheet 1, thus, in the embodiment, the positive conductive terminal 14 abuts against the positive conductive layer on the bottom surface of the ultrasonic atomization sheet 1, and the negative contact plate 11 fits the negative conductive layer on the bottom surface of the ultrasonic atomization sheet 1.

The ultrasonic electronic cigarette atomizer further includes a cotton pressing spring 18, the top end of the cotton pressing spring 18 extends into the air outlet tube 7 and abuts against the bottom end of the inner side wall of the air outlet tube 7, and the bottom end of the cotton pressing spring 18 abuts against the inner bottom surface of the liquid guide body 4.

The cigarette liquid cavity 6 is formed by the outer side wall of the air tube support 8, the inner side wall of the atomization sleeve 5, and the outer side wall of the threaded sleeve support 10.

A sealing ring 17 for sealing cigarette liquid is further arranged between the outer side wall of the threaded sleeve support 10 and the inner side wall of the atomization sleeve 5.

Embodiment 2 of Electronic Cigarette

Figure 19:
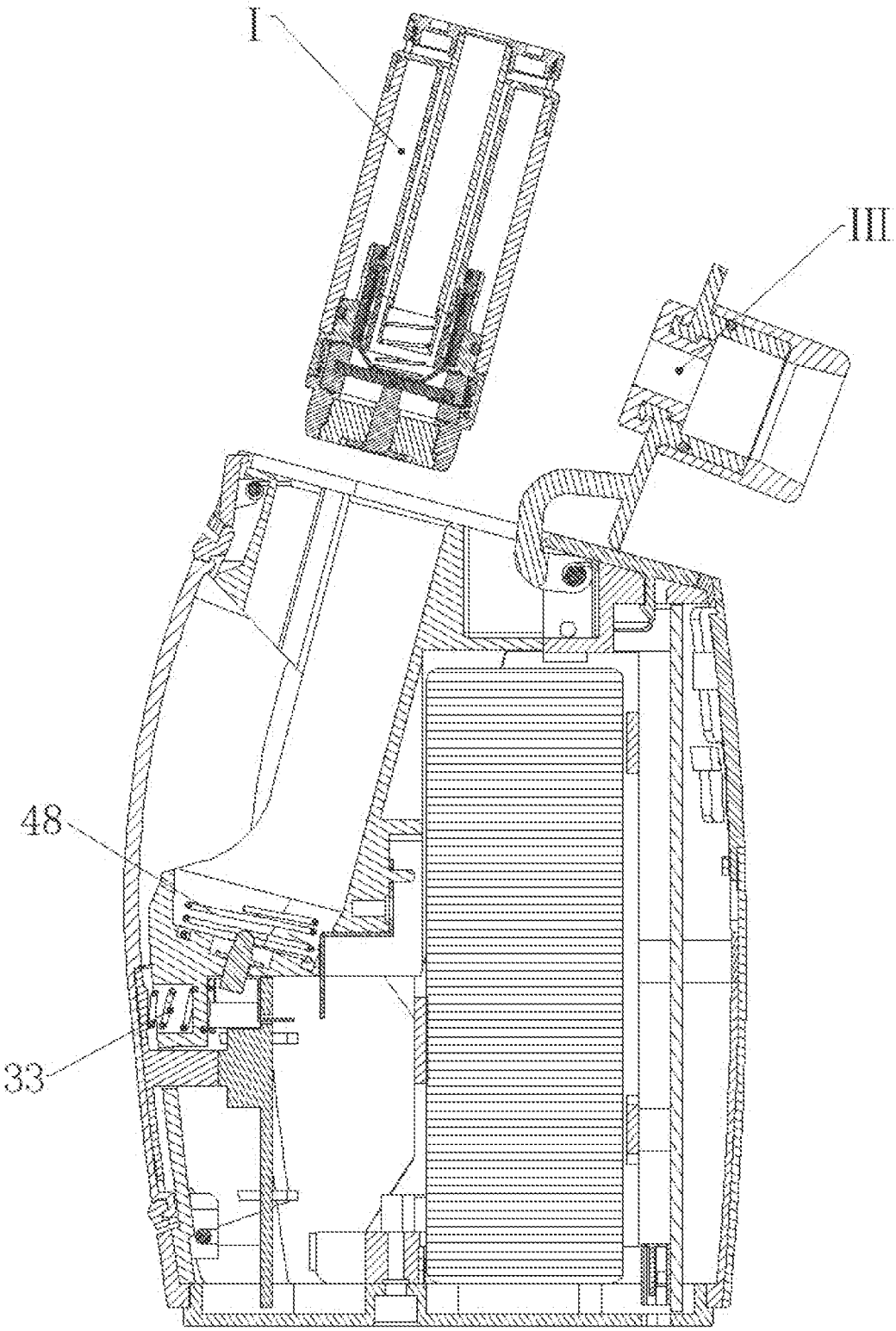
FIG. 19 is a cross-sectional view of an exploded view of components in Embodiment 2 of the electronic cigarette.

As shown in FIG. 19, the structure in Embodiment 2 of the electronic cigarette is similar to that in Embodiment 1, the difference between Embodiment 2 and Embodiment 1 is that a spring 48 is arranged in the receiving cavity 211. When the ultrasonic atomizer I is placed in the receiving cavity 211, the bottom end of the spring 48 abuts against the bottom surface of the receiving cavity 211, and the top end of the spring 48 abuts against the inner bottom surface of the ultrasonic atomizer I.

The spring 48 is arranged in the receiving cavity 211, and the spring 48 ejects the ultrasonic atomizer I from the receiving cavity 211 after the upper cover assembly III is opened, so that the user can replace the ultrasonic atomizer I conveniently.

The embodiments of the present invention are described above with reference to the drawings, but the present invention is not limited to the specific embodiments. The specific embodiments described above are merely illustrative but not restrictive. Many forms may also be made by those of ordinary skill in the art under the enlightenment of the present invention without departing from the purpose of the present invention and the scope of the claims, and these forms fall into the scope of the present invention.

What is claimed is:

1. An ultrasonic atomization type electronic cigarette, comprising an ultrasonic atomizer (I), the ultrasonic atomizer (I) including an ultrasonic atomization sheet (1), wherein the angle between the ultrasonic atomization sheet (1) and the central axis of the electronic cigarette is α, and the value of α is 5° to 85°, preferably 15° to 55°.

2. The ultrasonic atomization type electronic cigarette according to claim 1, further comprising an electronic cigarette housing (II) and a nozzle (3) connected to the electronic cigarette housing (II), wherein the electronic cigarette housing (II) is provided with an air inlet groove (20), a first support (21) is arranged in the electronic cigarette housing (II), a receiving cavity (211) for receiving the ultrasonic atomizer (I) is formed in the first support (21), and the angle between the central axis of the receiving cavity (211) and the central axis of the electronic cigarette is α; and wherein the air inlet groove (20), an atomization surface of the ultrasonic atomization sheet (1), and the nozzle (3) are connected in sequence.

3. The ultrasonic atomization type electronic cigarette according to claim 2, wherein a cavity (22) is formed between the outer side wall of the first support (21) and the inner side wall of the electronic cigarette housing (II), and wherein the air inlet groove (20), the cavity (22), an air groove (212) on the inner side wall of the receiving cavity (211), the atomization surface of the ultrasonic atomization sheet (1), and the nozzle (3) are connected in sequence.

4. The ultrasonic atomization type electronic cigarette according to claim 2, wherein the ultrasonic atomizer (I) is detachably connected to the first support (21), and wherein the ultrasonic atomizer (I) further includes an upper cover assembly (III) capable of opening the receiving cavity (211) and a locking structure (IV) capable of locking the upper cover assembly (III).

5. The ultrasonic atomization type electronic cigarette according to claim 4, wherein the upper cover assembly (III) includes a flip cover (23) and a gasket (24) that can press the ultrasonic atomizer (I), the gasket (24) and the nozzle (3) are respectively located at two ends of the flip cover (23), one side of the flip cover (23) is pivotally connected to the first support (21), and the other side of the flip cover (23) is provided with a locking groove (231); wherein the locking structure (IV) includes a rotating buckle (25), the rotating buckle (25) is pivotally connected to the first support (21), and the rotating buckle (25) is provided with a locking buckle (251) that matches the locking groove (231).

6. The ultrasonic atomization type electronic cigarette according to claim 4, wherein a spring (48) is arranged in the receiving cavity (211); wherein, when the ultrasonic atomizer (I) is placed in the receiving cavity (211), the bottom end of the spring (48) abuts against the bottom surface of the receiving cavity (211), and the top end of the spring (48) abuts against the inner bottom surface of the ultrasonic atomizer (I).

7. The ultrasonic atomization type electronic cigarette according to claim 2, wherein the electronic cigarette housing (II) includes an upper side housing (26) and a lower side housing (27) which are oppositely arranged, and a side housing (28) and a decorative block (29) which are oppositely arranged; wherein the upper side housing (26) is connected to the lower side housing (27) through the side housing (28), the bottom of the lower side housing (27) is provided with a bottom cover (30) for sealing, the top of the upper side housing (26) is provided with a top cover (31) for sealing, one end of the decorative block (29) is pivotally connected to the first support (21), and the other end of the decorative block (29) is clamped in the upper side housing (26); wherein a key switch board (32) is arranged in the electronic cigarette housing (II), a key switch (321) is arranged on the key switch board (32), and a pressing column (291) in contact with the key switch (321) is arranged on the decorative block (29).

8. The ultrasonic atomization type electronic cigarette according to claim 7, further comprising a compression spring (33), wherein the pressing column (291) is in contact with the key switch (321) after passing through the first support (21), one end of the compression spring (33) abuts against the inner side wall of the decorative block (29), and the other end of the compression spring (33) abuts against the outer side wall of the first support (21).

9. The ultrasonic atomization type electronic cigarette according to claim 7, wherein the electronic cigarette housing (II) further includes a transparent block (39) opposite to a central through region of the decorative block (29), the inner side wall of the transparent block (39) fits the outer side wall of the decorative block (29), and the transparent block (39) is buckled with the first support (21).

10. The ultrasonic atomization type electronic cigarette according to claim 2, wherein the ultrasonic atomizer (I) includes an atomization sleeve (5), the ultrasonic atomization sheet (1) is arranged in the atomization sleeve (5), a cigarette liquid cavity (6) and a liquid guide structure for connecting the cigarette liquid cavity (6) with the ultrasonic atomization sheet (1) are further arranged in the atomization sleeve (5), and the liquid guide structure includes a liquid guide body (4); wherein the liquid guide body (4) includes a first liquid guide layer (401) and a second liquid guide layer (402), and a side of the first liquid guide layer (401) is sandwiched between a side of the second liquid guide layer (402) and the atomization surface of the ultrasonic atomization sheet (1).

11. The ultrasonic atomization type electronic cigarette according to claim 10, wherein the first liquid guide layer (401) and the second liquid guide layer (402) are both cup-shaped, the first liquid guide layer (401) is wrapped outside the second liquid guide layer (402), and the bottom surface of the first liquid guide layer (401) is sandwiched between the bottom surface of the second liquid guide layer (402) and the ultrasonic atomization sheet (1).

12. The ultrasonic atomization type electronic cigarette according to claim 11, wherein the liquid guide structure further includes a liquid reservoir (2) wrapped on the outer side wall of the first liquid guide layer (401), and the outer side wall of the liquid reservoir (2) is communicated with the cigarette liquid cavity (6).

13. The ultrasonic atomization type electronic cigarette according to claim 10, wherein the first liquid guide layer (401) is cup-shaped, the second liquid guide layer (402) is flaky, and the second liquid guide layer (402) covers the inner bottom surface of the first liquid guide layer (401).

14. The ultrasonic atomization type electronic cigarette according to claim 13, wherein the liquid guide structure further includes a liquid reservoir (2) wrapped on the outer side wall of the first liquid guide layer (401), and the outer side wall of the liquid reservoir (2) is communicated with the cigarette liquid cavity (6).

15. The ultrasonic atomization type electronic cigarette according to claim 14, wherein the ultrasonic atomizer (I)

further includes an air outlet tube (7), an air tube support (8), a nozzle (3), an atomization support (9), a threaded sleeve support (10), a negative contact plate (11), an atomization seat (12), a negative threaded sleeve (13), a positive conductive terminal (14), and a terminal block (15); wherein the ultrasonic atomization sheet (1) is perpendicular to the axis of the atomization sleeve (5), the top end of the air outlet tube (7) is communicated with the nozzle (3), the bottom end of the air outlet tube (7) extends into the inner cavity of the liquid guide body (4), the top end of the side wall of the air tube support (8) is provided with an air inlet (81), the air outlet tube (7) is sleeved in the air tube support (8), and an air inlet channel (16) for connecting the air inlet (81) with the air outlet tube (7) is formed between the inner side wall of the air tube support (8) and the outer side of the air outlet tube (7); wherein the bottom of the outer side wall of the air tube support (8) is screwed to the top of the inner side wall of the atomization support (9), the side wall of the liquid guide body (4) is sleeved outside the side wall of the atomization support (9), the external of the liquid reservoir (2) is sleeved with a threaded sleeve support (10), the threaded sleeve support (10) is provided with a liquid passing hole (101) for connecting the cigarette liquid cavity (6) with the liquid reservoir (2), the atomization seat (12) is arranged in the top of the negative threaded sleeve (13), the top of the outer side wall of the negative threaded sleeve (13) is screwed to the bottom of the inner side wall of the threaded sleeve support (10), the terminal block (15) is arranged in the bottom of the negative threaded sleeve (13), and the positive conductive terminal (14) passes through the terminal block (15) and abuts against the positive conductive layer of the ultrasonic atomization sheet (1); wherein one end of the negative contact plate (11) fits the negative conductive layer of the ultrasonic atomization sheet (1), and the other end of the negative contact plate (11) passes through the atomization seat (12) and is in contact with the negative threaded sleeve (13).

16. The ultrasonic atomization type electronic cigarette according to claim 10, wherein the first liquid guide layer (401) is made of a wear-resistant material.

17. The ultrasonic atomization type electronic cigarette according to claim 10, wherein the second liquid guide layer (402) is a filter screen.

18. The ultrasonic atomization type electronic cigarette according to claim 10, wherein the bottom surface of the first liquid guide layer (401) is provided with a through hole (411) for connecting the bottom surface of the second liquid guide layer (402) with the atomization surface of the ultrasonic atomization sheet (1).

19. The ultrasonic atomization type electronic cigarette according to claim 2, wherein the ultrasonic atomizer (I) further includes a threaded sleeve support (10), a negative contact plate (11), an atomization seat (12), a negative threaded sleeve (13), a positive conductive terminal (14), and a terminal block (15); wherein the ultrasonic atomization sheet (1) is placed in the atomization sleeve (5) and is perpendicular to the axis of the atomization sleeve (5), the atomization seat (12) is arranged in the top of the negative threaded sleeve (13), the top of the outer side wall of the negative threaded sleeve (13) is screwed to the bottom of the inner side wall of the threaded sleeve support (10), the bottom end of the atomization sleeve (5) is sleeved outside the threaded sleeve support (10), the terminal block (15) is arranged in the bottom of the negative threaded sleeve (13), and the positive conductive terminal (14) passes through the terminal block (15) and abuts against a positive conductive layer of the ultrasonic atomization sheet (1); wherein one end of the negative contact plate (11) fits a negative conductive layer of the ultrasonic atomization sheet (1), and the other end of the negative contact plate (11) passes through the atomization seat (12) and is in contact with the negative threaded sleeve (13); wherein an elastic electrode (40) abutting against the positive conductive terminal (14) is arranged on the bottom surface of the receiving cavity (211), and the elastic electrode (40) is fixedly connected to the key switch board (32) through a first contact plate (41); wherein a second contact plate (42) abutting against the negative threaded sleeve (13) is arranged on the side wall of the receiving cavity (211).

20. The ultrasonic atomization type electronic cigarette according to claim 19, wherein the ultrasonic atomizer (I) further includes an atomization cover (19), the top end of the air outlet tube (7) is fixedly connected to the atomization cover (19) and communicates with the nozzle (3), and the air inlet groove (20), the cavity (22), the air groove (212) on the inner side wall of the receiving cavity (211), the air inlet (81), the air inlet channel (16), the atomization surface of the ultrasonic atomization sheet (1), the air outlet tube (7), and the nozzle (3) are connected in sequence.

* * * * *